US010553166B2

(12) United States Patent
Seo et al.

(10) Patent No.: US 10,553,166 B2
(45) Date of Patent: Feb. 4, 2020

(54) DISPLAY APPARATUS AND METHOD OF DRIVING THE DISPLAY APPARATUS

(71) Applicant: Samsung Display Co., Ltd., Yongin, Gyeonggi-Do (KR)

(72) Inventors: Ji-Myoung Seo, Hwaseong-si (KR); Su-Hyeong Park, Gyeongju-si (KR); Soo-Wan Yoon, Hwaseong-si (KR); Hee-Soon Jeong, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 118 days.

(21) Appl. No.: 14/671,982

(22) Filed: Mar. 27, 2015

(65) Prior Publication Data

US 2016/0049136 A1 Feb. 18, 2016

(30) Foreign Application Priority Data

Aug. 18, 2014 (KR) ..... 10-2014-0107004

(51) Int. Cl.
*G09G 3/36* (2006.01)

(52) U.S. Cl.
CPC ..... *G09G 3/3611* (2013.01)

(58) Field of Classification Search
None
See application file for complete search history.

(56) References Cited

U.S. PATENT DOCUMENTS 4,621,260 A * 11/1986 Suzuki ..... G02F 1/136213 257/E27.111
5,777,515 A * 7/1998 Kimura ..... H03F 3/45183 330/257
5,784,039 A * 7/1998 Yasui ..... G09G 3/3648 345/89
6,052,103 A * 4/2000 Fujiwara ..... G09G 3/3651 345/89
6,115,018 A * 9/2000 Okumura ..... G09G 3/3648 345/95
6,177,965 B1 * 1/2001 Takahara ..... G02F 1/133526 348/E5.141
6,246,385 B1 * 6/2001 Kinoshita ..... G09G 3/3644 345/87
6,590,552 B1 * 7/2003 Yokoyama ..... G09G 3/3655 345/100

(Continued)

FOREIGN PATENT DOCUMENTS

CN 101118357 A 2/2008
CN 101965607 A 2/2011

(Continued)

*Primary Examiner* — William Boddie
*Assistant Examiner* — Bipin Gyawali
(74) *Attorney, Agent, or Firm* — Lewis Roca Rothgerber Christie LLP

(57) ABSTRACT

A display apparatus includes: a display panel including a gate line, a storage line adjacent to the gate line, and a pixel, the pixel including a pixel transistor coupled to the gate line, a liquid crystal ("LC") capacitor coupled to the pixel transistor, and a storage capacitor coupled to the LC capacitor; a first gate driver configured to provide a gate signal to the gate line; and a first level switch configured to provide a storage signal to the storage line, the storage signal being synchronized with the gate signal and having a phase opposite to a phase of the gate signal.

18 Claims, 16 Drawing Sheets

(56) References Cited

U.S. PATENT DOCUMENTS 6,680,720 B1 * 1/2004 Lee ..... G09G 3/3655 345/100
7,027,024 B2 * 4/2006 Yanagi ..... G09G 3/3648 345/94
7,936,332 B2 * 5/2011 Lee ..... G09G 3/3677 345/100
7,969,396 B2 6/2011 Kim
8,059,780 B2 * 11/2011 Wang ..... G11C 19/28 377/64
8,063,860 B2 11/2011 Choi et al.
8,199,087 B2 6/2012 Toya et al.
8,264,250 B2 * 9/2012 Kim ..... G09G 3/006 324/760.01
8,587,572 B2 11/2013 Sasaki et al.
8,896,583 B2 11/2014 Xue et al.
9,052,538 B2 * 6/2015 Lee ..... G02F 1/13306
9,148,148 B2 * 9/2015 Park ..... H03K 19/01852
9,280,953 B2 * 3/2016 Liao ..... G09G 5/18
9,378,710 B2 * 6/2016 Sasanuma ..... G09G 3/3655
10,078,987 B2 * 9/2018 Lee ..... G09G 3/2092
2004/0189884 A1 * 9/2004 Kim ..... G02F 1/136213 349/38
2006/0145978 A1 * 7/2006 Takatori ..... G09G 3/2014 345/87
2006/0145985 A1 * 7/2006 Hwang ..... G09G 3/3655 345/92
2006/0231838 A1 * 10/2006 Kim ..... G02F 1/136213 257/59
2007/0262938 A1 * 11/2007 Kim ..... G02F 1/13624 345/92
2007/0296682 A1 * 12/2007 Hwang ..... G09G 3/3677 345/100
2008/0094314 A1 * 4/2008 Huitema ..... G09G 3/344 345/55
2009/0128527 A1 * 5/2009 Itakura ..... G09G 3/3655 345/205
2009/0147164 A1 * 6/2009 Toyoshima ..... G09G 3/3655 349/39
2009/0189677 A1 * 7/2009 Lee ..... G09G 3/3677 327/427
2009/0231504 A1 * 9/2009 Toya ..... G09G 3/3648 349/39
2010/0045884 A1 * 2/2010 Ahn ..... G02F 1/13624 349/37
2010/0073354 A1 * 3/2010 Kim ..... G09G 3/3648 345/213
2010/0245328 A1 * 9/2010 Sasaki ..... G09G 3/3655 345/211
2011/0001743 A1 * 1/2011 Yamato ..... G09G 3/3614 345/212
2011/0273416 A1 * 11/2011 Bae ..... G09G 3/3648 345/211
2012/0092312 A1 * 4/2012 Xue ..... G09G 3/3655 345/205
2012/0139883 A1 * 6/2012 Lee ..... G09G 3/3611 345/204
2012/0169690 A1 * 7/2012 Sasaki ..... G09G 3/3659 345/209
2012/0200614 A1 * 8/2012 Yamamoto ..... G09G 3/3614 345/690
2012/0229523 A1 * 9/2012 Maruyama ..... G09G 3/3648 345/690
2013/0009924 A1 * 1/2013 Imai ..... G09G 3/3655 345/204
2013/0093658 A1 * 4/2013 Park ..... G02F 1/13452 345/92
2013/0249882 A1 * 9/2013 Lin ..... G09G 3/3648 345/212
2015/0185531 A1 * 7/2015 Xu ..... G02F 1/136286 349/43
2015/0235590 A1 * 8/2015 Peng ..... G09G 3/3674 327/109
2016/0133216 A1 * 5/2016 Song ..... G09G 3/3696 345/205
2016/0240158 A1 * 8/2016 Xu ..... G11C 19/28
2017/0084247 A1 * 3/2017 Yang ..... G09G 5/003

FOREIGN PATENT DOCUMENTS

CN 102222456 A 10/2011
JP 2009-222839 A 10/2009
KR 10-2008-0043097 A 5/2008
KR 10-2008-0054549 A 6/2008
KR 10-2013-0072909 A 7/2013

* cited by examiner

DISPLAY APPARATUS AND METHOD OF DRIVING THE DISPLAY APPARATUS

CROSS-REFERENCE TO RELATED APPLICATION

This application claims priority to and the benefit of Korean Patent Application No. 10-2014-0107004, filed on Aug. 18, 2014 in the Korean Intellectual Property Office KIPO, the content of which is herein incorporated by reference in its entirety.

BACKGROUND

1. Field

Aspects of example embodiments of the present invention relate to a display apparatus and a method of driving the display apparatus. More particularly, aspects of example embodiments of the present invention relate to a display apparatus with improved display quality and a method of driving the display apparatus.

2. Description of the Related Art

A liquid crystal display ("LCD") panel may include a thin film transistor ("TFT") substrate, an opposing substrate, and an LC layer disposed between the two substrates.

The TFT substrate may include a plurality of gate lines, a plurality of data lines crossing the gate lines, a plurality of TFTs coupled (e.g., connected) to the gate lines and the data lines, and a plurality of pixel electrodes coupled to the TFTs. A TFT may include a gate electrode extending from a gate line, a source electrode extending to a data line, and a drain electrode spaced from the source electrode. The opposing substrate may include a common electrode opposite to the pixel electrode.

An LC capacitor is defined by the pixel electrode, the LC layer, and the common electrode. The common electrode receives a common voltage, and the pixel electrode receives a data voltage having a positive or a negative phase with respect to the common electrode.

The data voltage for the pixel electrode is changed by a kickback voltage, which occurs by a coupling capacitor between a gate electrode and a source electrode of the TFT, the LC capacitor, and a voltage difference between a gate on voltage and a gate off voltage of a gate signal for a gate line.

SUMMARY

An aspect of one or more example embodiments of the present invention is directed toward a display apparatus capable of compensating for a kickback voltage.

An aspect of one or more example embodiments of the present invention is directed toward a method of driving the display apparatus.

According to an example embodiment of the inventive concept, there is provided a display apparatus including: a display panel including a gate line, a storage line adjacent to the gate line, and a pixel, the pixel including a pixel transistor coupled to the gate line, a liquid crystal ("LC") capacitor coupled to the pixel transistor, and a storage capacitor coupled to the LC capacitor; a first gate driver configured to provide a gate signal to the gate line; and a first level switch configured to provide a storage signal to the storage line, the storage signal being synchronized with the gate signal and having a phase opposite to a phase of the gate signal.

In an example embodiment, the storage signal may include a first storage low voltage during a period when the gate signal has a gate on voltage, and a storage high voltage during a period when the gate signal has a gate off voltage.

In an example embodiment, a first swing voltage between the first storage low voltage and the storage high voltage may be utilized to compensate for a kickback voltage of the pixel.

In an example embodiment, one of a first swing voltage and the first storage low voltage may be equal to a common voltage for the LC capacitor.

In an example embodiment, the display panel may be divided into a display area including the pixel, and a peripheral area surrounding the display area, and the first gate driver may be on the peripheral area and may be configured to generate an opposite gate signal having a phase opposite to that of the gate signal.

In an example embodiment, the first gate driver may include the first level switch.

In an example embodiment, the first level switch may include: a first switch configured to output the first storage low voltage to the storage line in response to a gate on voltage of the gate signal and a gate off voltage of the opposite gate signal; and a second switch configured to output the storage high voltage to the storage line in response to a gate on voltage of the opposite gate signal and a gate off voltage of the gate signal.

In an example embodiment, the display apparatus may further include a second level switch on a portion of the peripheral area that is adjacent to a second end portion of the gate line, and the first gate driver may be on another portion of the peripheral area that is adjacent to a first end portion of the gate line.

In an example embodiment, the display panel may further include a control line configured to transfer the opposite gate signal.

In an example embodiment, the second level switch may include: a third switch configured to output a second storage low voltage greater than the first storage low voltage to the storage line in response to a gate on voltage of the gate signal, and a fourth switch configured to output the storage high voltage to the storage line in response to a gate on voltage of the opposite gate signal transferred through the control line.

In an example embodiment, a kickback voltage of a first pixel adjacent to the first gate driver may be configured to be compensated by a first swing voltage between the first storage low voltage and the storage high voltage, and a kickback voltage of a second pixel adjacent to the second level switch may be configured to be compensated by a second swing voltage between the second storage low voltage and the storage high voltage.

In an example embodiment, the display apparatus may further include a second gate driver, and the first gate driver circuit may be on a portion of the peripheral area that is adjacent to a first end portion of the gate line, and the second gate driver may be on another portion of the peripheral area that is adjacent to a second end portion of the gate line.

In an example embodiment, the first level switch may be directly integrated in the peripheral area, and may include: a first switch configured to output the first storage low voltage to the storage line in response to a gate on voltage of the gate signal and a gate off voltage of the opposite gate signal; and a second switch configured to output the storage high voltage to the storage line in response to a gate on voltage of the opposite gate signal and a gate off voltage of the gate signal.

In an example embodiment, the display panel may be divided into a display area including the pixel, and a peripheral area surrounding the display area, and the first gate driver may be directly integrated in the peripheral area.

In an example embodiment, the first gate driver may include a plurality of stages coupled one after another to each other, and including an n-th stage ("n" is a natural number) including: a pull-up part configured to output a high voltage of an n-th gate signal by utilizing a high voltage of a clock signal in response to a high voltage of a control node; a control pull-down part configured to pull-down a voltage of the control node to a low voltage in response to a carry signal outputted from at least one of next stages of the n-th stage; a carry part configured to output the high voltage of the clock signal as an n-th carry signal in response to the high voltage of the control node; and a first level switch part configured to provide an n-th storage signal to an n-th storage line, the n-th storage signal being synchronized with the n-th gate signal and having a phase opposite to a phase of the n-th gate signal.

In an example embodiment, the n-th stage may further include: an output pull-down part configured to pull-down the n-th gate signal to the low voltage in response to a carry signal outputted from at least one of next stages of the n-th stage.

According to another example embodiment of the inventive concept, there is provided a method of driving a display apparatus including a gate line, a storage line adjacent to the gate line, and a pixel, the pixel including a pixel transistor coupled to the gate line, a liquid crystal ("LC") capacitor coupled to the pixel transistor, and a storage capacitor coupled to the LC capacitor, the method including: providing a gate signal to the gate line; and providing a storage signal to the storage line, the storage signal being synchronized with the gate signal and having a phase opposite to a phase of the gate signal.

In an example embodiment, the method may further include: providing a first end portion of the storage line with the storage signal, the storage signal having a first storage low voltage during a period when the gate signal has a gate on voltage, and a storage high voltage during a period when the gate signal has a gate off voltage.

In an example embodiment, the method may further include: providing a second end portion of the storage line with the storage signal, the storage signal having a second storage low voltage that is greater than the first storage low voltage during a period when the gate signal has a gate on voltage, and the storage high voltage during a period when the gate signal has a gate off voltage.

In an example embodiment, one of a first swing voltage and the first storage low voltage may be equal to a common voltage for the LC capacitor.

According to some example embodiments of the present invention, the storage signal for the storage capacitor comprises a multi-level signal swing between a low voltage and a high voltage that is in synchronization with the gate signal, and thus, the kickback voltage may be compensated without reference to a change of the LC capacitance.

BRIEF DESCRIPTION OF THE DRAWINGS

The above and other features and aspects of the present invention will become more apparent by describing in the detailed example embodiments thereof with reference to the accompanying drawings, in which.

DETAILED DESCRIPTION

Figure 1:
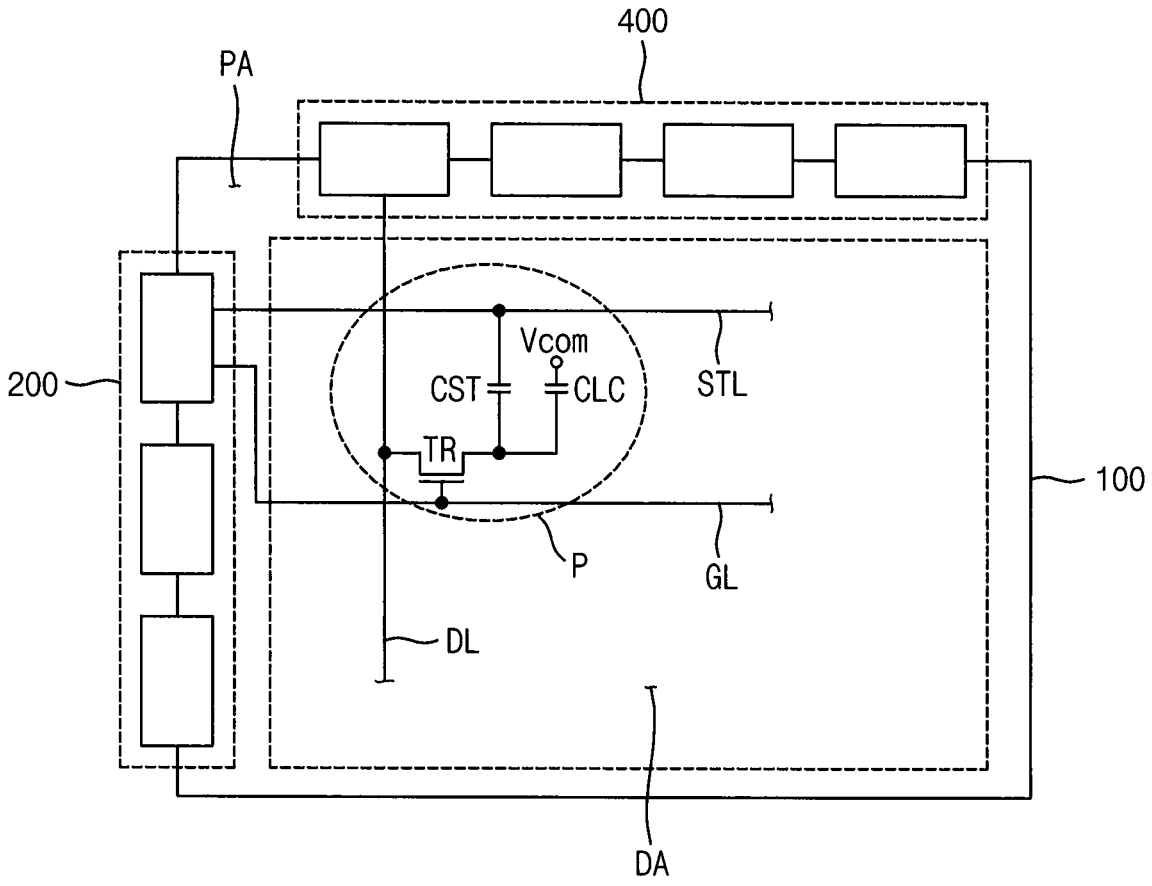
FIG. 1 is a block diagram view schematically showing a display apparatus according to an example embodiment.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey some of the aspects and features of the present invention to those skilled in the art. Accordingly, processes, elements, and techniques that are not necessary to those having ordinary skill in the art for a complete understanding of the aspects and features of the present invention are not described with respect to some of the embodiments of the present invention. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises" and/or "comprising," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the present invention refers to "one or more embodiments of the present invention." The terms "use," "using," and "used" may be considered synonymous with the terms "utilize," "utilizing," and "utilized," respectively. Also, the term "exemplary" is intended to refer to an example or illustration.

It will be understood that when an element or layer is referred to as being "on," "connected to," or "coupled to" another element or layer, it can be directly on, connected to, or coupled to the other element or layer, or one or more intervening elements or layers may be present. However, when an element or layer is referred to as being "directly on," "directly connected to," or "directly coupled to" another element or layer, there are no intervening elements or layers present.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram view schematically showing a display apparatus according to an example embodiment.

Referring to FIG. 1, the display apparatus may include a display panel 100, a gate driver circuit 200 (e.g., a gate driver), and a data driver circuit 400 (e.g., a data driver).

The display panel 100 may be divided into a display area DA, and a peripheral area PA surrounding the display area DA. A plurality of gate lines, a plurality of data lines, and a plurality of pixel units (e.g., pixels) are disposed in the display area DA. Each of the pixel units P include a pixel transistor TR, which is electrically coupled (e.g., electrically connected) to a gate line GL and a data line DL, a liquid crystal ("LC") capacitor CLC, which is electrically coupled to the pixel transistor TR, and a storage capacitor CST, which is electrically coupled to the LC capacitor CLC.

The LC capacitor CLC includes a first electrode coupled (e.g., connected) to the pixel transistor TR, and a second electrode for receiving a common voltage Vcom. The first electrode may be a pixel electrode, which is disposed on an array substrate of the display panel 100, and the second electrode may be a common electrode, which is disposed on an opposing substrate opposite to the array substrate. Alternatively, the common electrode may be disposed on the array substrate.

The storage capacitor CST includes a third electrode coupled to the first electrode of the LC capacitor CLC, and a fourth electrode coupled to a storage line STL. The third electrode may be the pixel electrode, and the fourth electrode may be the storage line STL, which overlaps with the pixel electrode.

The gate driver circuit 200 may be disposed on the peripheral area PA, such as a tape carrier package ("TCP"), and is coupled to the gate lines GL and the storage lines STL.

The gate driver circuit 200 is configured to output a plurality of gate signals to the gate lines GL. In addition, the gate driver circuit 200 is configured to output a plurality of storage signals to the storage lines STL.

The storage signals are synchronized with the gate signals and have a phase opposite to the gate signals. For example, a storage signal has a storage low voltage during a period in which a gate signal has a gate on voltage, and a storage high voltage during a period in which a gate signal has a gate off voltage.

A voltage drop of a pixel voltage charged in the LC capacitor CLC by a kickback voltage may be compensated using a swing voltage between the storage high voltage and the storage low voltage.

Expression 1 shows a mechanism for compensating for the kickback voltage ΔVkb using a swing voltage VSTH-VSTL between the storage high voltage VSTH and the storage low voltage VSTL according to an example embodiment.

$$\Delta V_{kb} = -\frac{C_{gs}}{C_{gs} + C_{ST} + C_{LC}}(V_{Gon} - V_{Goff}) + \frac{C_{ST}}{C_{gs} + C_{ST} + C_{LC}}(V_{ST,H} - V_{ST,L}) \quad \text{Expression 1}$$

$$\text{For } \Delta V_{kb} = 0,\ (V_{STH} - V_{STL}) = \frac{C_{gs}}{C_{ST}}(V_{Gon} - V_{Goff})$$

In the above Expression 1, Cgs is a gate/source capacitance of a pixel transistor, $C_{ST}$ is a capacitance of the storage capacitor $C_{ST}$, $C_{LC}$ is a capacitance of the LC capacitor CLC, $V_{GON}$ is the gate on voltage and $V_{GOFF}$ is the gate off voltage.

According to Expression 1, the kickback voltage ΔVkb may be compensated by the swing voltage between the storage high voltage VSTH and the storage low voltage VSTL.

In addition, according to Expression 1, a compensating voltage for compensating the kickback voltage ΔVkb may be determined by a ratio of the gate/source capacitance Cgs and the storage capacitance $C_{ST}$, and thus, design degrees of freedom of the gate/source capacitance Cgs and the storage capacitance $C_{ST}$ may be increased. In order to prevent or reduce the kickback voltage ΔVkb, it is desirable to reduce the storage capacitance CST. The storage capacitance CST may be reduced, and thus, an aperture opening size of the pixel unit may be increased.

In addition, according to Expression 1, the compensating voltage for compensating the kickback voltage ΔVkb is unrelated to the LC capacitance $C_{LC}$, thus, the kickback voltage ΔVkb may be compensated without reference to a change of the LC capacitance $C_{LC}$, which is a change of a data voltage based on a grayscale (e.g., grayscale level or value).

The data driver circuit 400 may be disposed on the peripheral area, such as the TCP, and is coupled to the data lines DL. The data driver circuit 400 is configured to output the data signals to the data lines.

Figure 2:
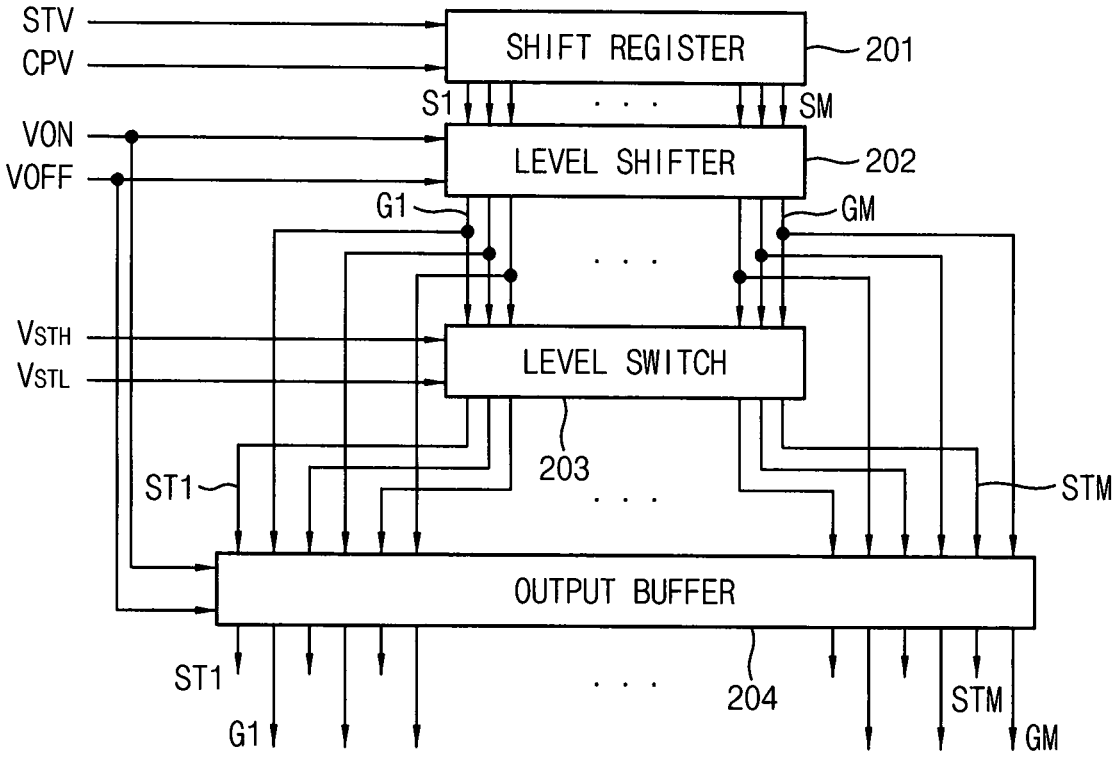
FIG. 2 is a block diagram illustrating a gate driver circuit shown in FIG. 1.

FIG. 2 is a block diagram illustrating a gate driver circuit shown in FIG. 1.

Referring to FIGS. 1 and 2, the gate driver circuit 200 may include a shift register 201, a level shifter 202, a level switch 203, and an output buffer 204.

The shift register 201 is configured to receive a vertical start signal STV and a gate clock signal CPV, and to output a plurality of signals S1, . . . , SM synchronized with the gate clock signal CPV ('M' is a natural number).

The level shifter 202 is configured to receive the signals S1, . . . , SM, and to generate a plurality of gate signals G1, . . . , GM using a gate on voltage VON and a gate off voltage VOFF.

The level switch 203 is configured to receive the gate signals G1, . . . , GM, and to generate a plurality of storage signals ST1, . . . , STM, which is respectively synchronized with the gate signals G1, . . . , GM and has a storage high voltage VSTH and a storage low voltage VSTL.

The output buffer 204 is configured to buffer the gate signals G1, . . . , GM and the storage signals ST1, . . . , STM provided from the level shifter 202 and the level switch 203, and to respectively output the gate signals G1, . . . , GM and the storage signals ST1, . . . , STM to the gate lines and the storage lines.

Figure 3:
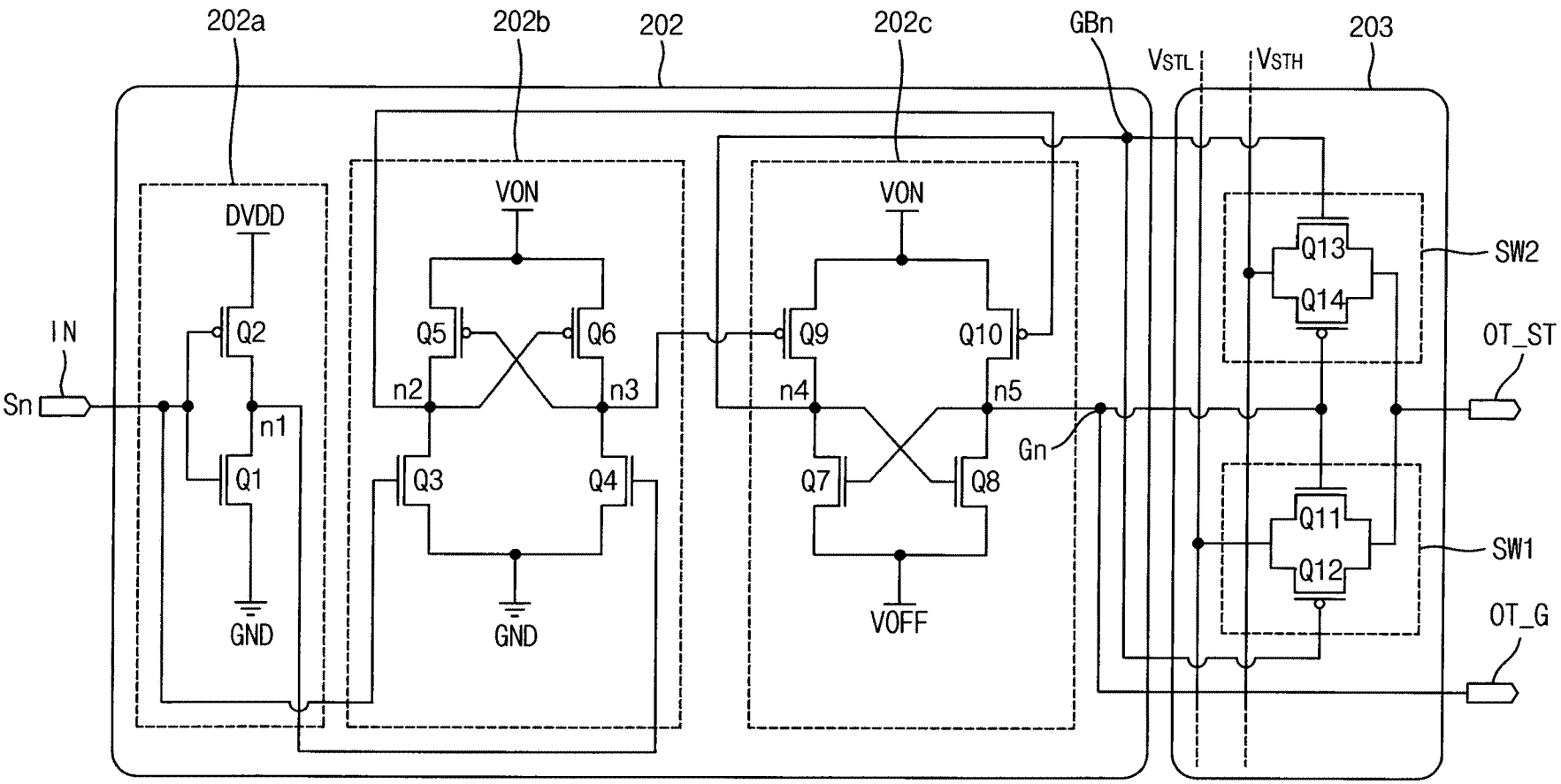
FIG. 3 is a circuit diagram illustrating a level shifter and a level switch shown in FIG. 2.
Figure 4:
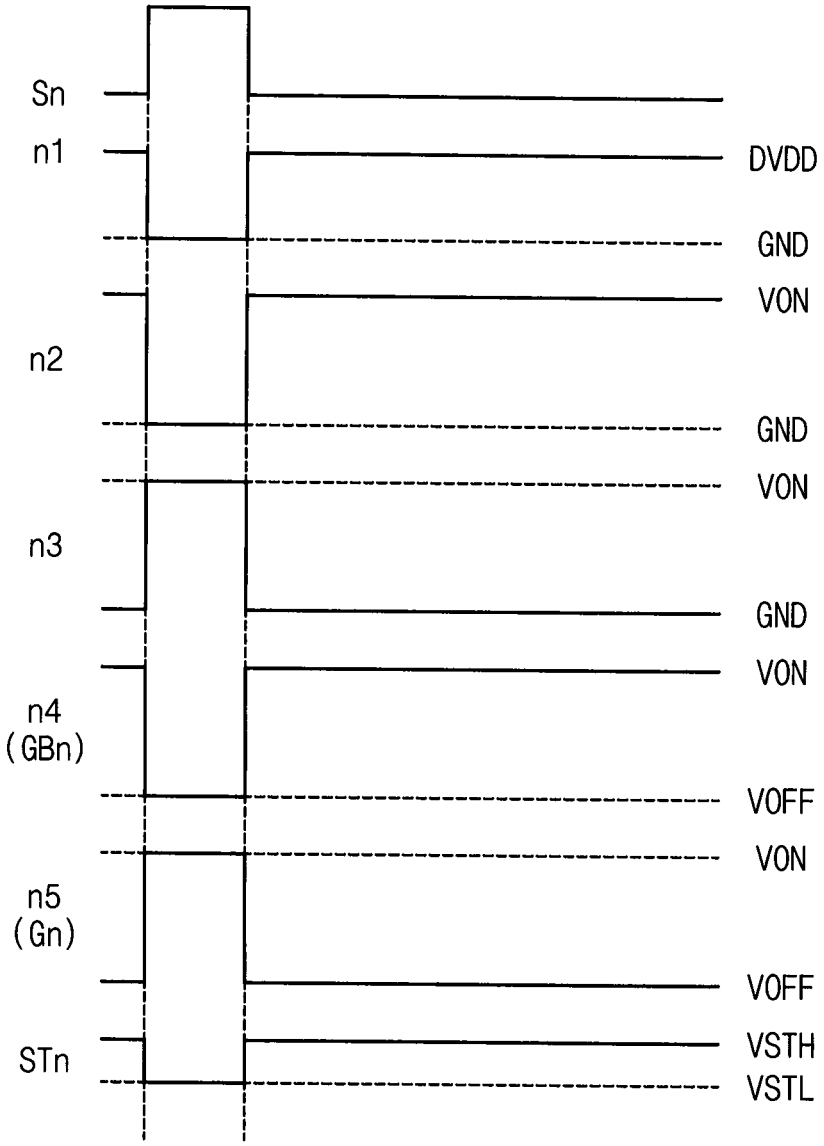
FIG. 4 is a waveform diagram illustrating signals for driving the level shifter and the level switch shown in FIG. 3.

FIG. 3 is a circuit diagram illustrating a level shifter and a level switch shown in FIG. 2. FIG. 4 is a waveform diagram illustrating signals for driving the level shifter and the level switch shown in FIG. 3.

Referring to FIGS. 2 and 3, the level shifter 202 may include a level inverter 202*a*, a first shifter 202*b*, and a second shifter 202*c*. The level switch 203 may include a first switch SW1 and a second switch SW2.

The level inverter 202*a* includes a first transistor Q1 of an N-type (e.g., N-channel) and a second transistor Q2 of a P-type (e.g., P-channel). The first transistor Q1 includes a gate electrode coupled (e.g., connected) to an input terminal IN, which receives an n-th signal Sn, an input electrode coupled to a first node n1, and an output electrode for receiving a ground voltage GND. The second transistor Q2 includes a control electrode coupled to the input terminal IN, an input electrode for receiving a source voltage DVDD, and an output electrode coupled to the first node n1.

The first shifter 202*b* includes third and fourth transistors Q3 and Q4 of the N-type, and fifth and sixth transistors Q5 and Q6 of the P-type.

The third transistor Q3 includes a control electrode (e.g., a gate electrode) coupled to the input terminal IN, an input electrode coupled to a second node n2, and an output electrode for receiving the ground voltage GND. The fourth transistor Q4 includes a control electrode coupled to the first node n1, an input electrode coupled to a third node n3, and an output electrode for receiving the ground voltage GND.

The fifth transistor Q5 includes a control electrode coupled to the third node n3, an input electrode for receiving a gate on voltage VON, and an output electrode coupled to the second node n2. The sixth transistor Q6 includes a control electrode coupled to the second node n2, an input electrode for receiving the gate on voltage VON, and an output electrode coupled to the third node n3.

The second shifter 202*c* includes seventh and eighth transistors Q7 and Q8 of the N-type, and ninth and tenth transistors Q9 and Q10 of the P-type.

The seventh transistor Q7 includes a control electrode coupled to a fifth node n5, an input electrode coupled to a fourth node n4, and an output electrode for receiving a gate off voltage VOFF. The eighth transistor Q8 includes a control electrode coupled to the fourth node n4, an input electrode coupled to the fifth node n5, and an output electrode for receiving the gate off voltage VOFF.

The ninth transistor Q9 includes a control electrode coupled to the third node n3, an input electrode for receiving the gate on voltage VON, and an output electrode coupled to the fourth node n4. The tenth transistor Q10 includes a control electrode coupled to the second node n2, an input electrode for receiving the gate on voltage VON, and an output electrode coupled to the fifth node n5.

The fifth node n5 is coupled to a gate output terminal OT_G, and the gate output terminal OT_G outputs the gate on voltage VON and the gate off voltage VOFF that are applied to the fifth node n5 as an n-th gate signal Gn.

The level switch 203 includes the first switch SW1 and the second switch SW2.

The first switch SW1 includes an eleventh transistor Q11 of the N-type and a twelfth transistor Q12 of the P-type.

The eleventh transistor Q11 includes a control electrode coupled to the fifth node n5, an input electrode for receiving a storage low voltage VSTL, and an output electrode coupled to a storage output terminal OT_ST, which outputs the n-th storage signal STn. The twelfth transistor Q12 includes a control electrode coupled to the fourth node n4, an input electrode for receiving the storage low voltage VSTL, and an output electrode coupled to the storage output terminal OT_ST.

The second switch SW2 includes a thirteenth transistor Q13 of the N-type and a fourteenth transistor Q14 of the P-type.

The thirteenth transistor Q13 includes a control electrode coupled to the fourth node n4, an input electrode for receiving the storage high voltage VSTH, and an output electrode coupled to the storage output terminal OT_ST, which outputs the n-th storage signal STn. The fourteenth transistor Q14 includes a control electrode coupled to the fifth node n5, an input electrode for receiving the storage high voltage VSTH, and an output electrode coupled to the storage output terminal OT_ST.

Referring to FIGS. 3 and 4, when the input terminal IN of the level shifter 202 receives a signal Sn of a high level, the first transistor Q1 turns on and the second transistor Q2 turns off, and thus, the ground voltage GND is applied to the first node n1.

The fourth transistor Q4 turns off in response to the ground voltage GND of the first node n1, and the third transistor Q3 turns on in response to the signal Sri of the high level, and thus, the ground voltage GND is applied to the second node n2.

The sixth transistor Q6 turns on in response to the ground voltage GND applied to the second node n2, and thus, the gate on voltage VON is applied to the third node n3. The fifth transistor Q5 turns off in response to the gate on voltage VON applied to the third node n3.

The tenth transistor Q10 turns on in response to the ground voltage GND applied to the second node n2, and thus, the gate on voltage VON is applied to the fifth node n5. The seventh transistor Q7 turns on in response to the gate on voltage VON applied to the fifth node n5, and thus, the gate off voltage VOFF is applied to the fourth node n4. The eighth transistor Q8 turns off in response to the gate off voltage VOFF applied to the fourth node n4.

Thus, the gate on voltage VON of the fifth node n5 is outputted as an n-th gate signal Gn of a high level through the gate output terminal OT_G. The gate off voltage VOFF of the fourth node n4 and the gate on voltage VON of the fifth node n5 are provided to the level switch 203. A signal applied to the fifth node n5 corresponds to the n-th gate signal Gn, and a signal applied to the n-th node n4 corresponds to an n-th opposite gate signal GBn having a phase opposite to the n-th gate signal Gn.

The eleventh transistor Q11 of the first switch SW1 turns on in response to the gate on voltage VON applied to the fifth node n5, and the twelfth transistor Q12 turns on in response to the gate off voltage VOFF applied to the fourth node n4. Thus, the storage low voltage VSTL is outputted as an n-th storage signal STn of a low level through the storage output terminal OT_ST.

The n-th storage signal STn is synchronized with the n-th gate signal Gn and has the storage low voltage VSTL of the low level during a period in which the n-th gate signal Gn has the gate on voltage VON.

When the input terminal IN of the level shifter 202 receives a signal Sn of a low level, the first transistor Q1 turns off and the second transistor Q2 turns on. Thus, the source voltage DVDD is applied to the first node n1.

The fourth transistor Q4 turns on in response to the source voltage DVDD applied to the first node n1, and the third transistor Q3 turns off in response to a signal Sn of the low level. Thus, the ground voltage GND is applied to the third node n3.

The fifth transistor Q5 turns on in response to the ground voltage GND applied to the third node n3, and thus, the gate on voltage VON is applied to the second node n2.

The sixth transistor Q6 turns off in response to the gate on voltage VON applied to the second node n2.

The ninth transistor Q9 turns on in response to the ground voltage GND applied to the third node n3, and thus, the gate on voltage VON is applied to the fourth node n4. The eighth transistor Q8 turns on in response to the gate on voltage VON applied to the fourth node n4, and thus, the gate off voltage VOFF is applied to the fifth node n5. The seventh transistor Q7 turns off in response to the gate off voltage VOFF applied to the fifth node n5, and the tenth transistor Q10 turns off in response to the gate on voltage VON applied to the second node n2.

Thus, the gate off voltage VOFF of the fifth node n5 is outputted as the n-th gate signal Gn of the low level through the gate output terminal OT_G. The gate on voltage VON of the fourth node n4 and the gate off voltage VOFF of the fifth node n5 are provided to the level switch 203. A signal applied to the fifth node n5 corresponds to the n-th gate signal Gn, and a signal applied to the n-th node n4 corresponds to the n-th opposite gate signal GBn having a phase opposite to the n-th gate signal Gn.

The thirteenth transistor Q13 of the second switch SW2 turns on in response to the gate on voltage VON applied to the fourth node n4, and the fourteenth transistor Q14 turns on in response to the gate off voltage VOFF. Thus, the storage high voltage VSTH is outputted into the n-th storage signal STn of the high level through the storage output terminal OT_ST.

The n-th storage signal STn is synchronized with the n-th gate signal Gn and has the storage high voltage VSTH during a period in which the n-th gate signal Gn has the gate off voltage VOFF.

As described above, the gate driver circuit according to an example embodiment outputs the n-th gate signal Gn and the n-th storage signal STn, which is synchronized with the n-th gate signal Gn and has a phase opposite to the n-th gate signal Gn. The n-th storage signal STn has the storage low voltage VSTL during a period in which the n-th gate signal Gn has the gate on voltage VON, and has the storage high voltage VSTH during a period in which the n-th gate signal Gn has the gate off voltage VOFF.

Figure 5:
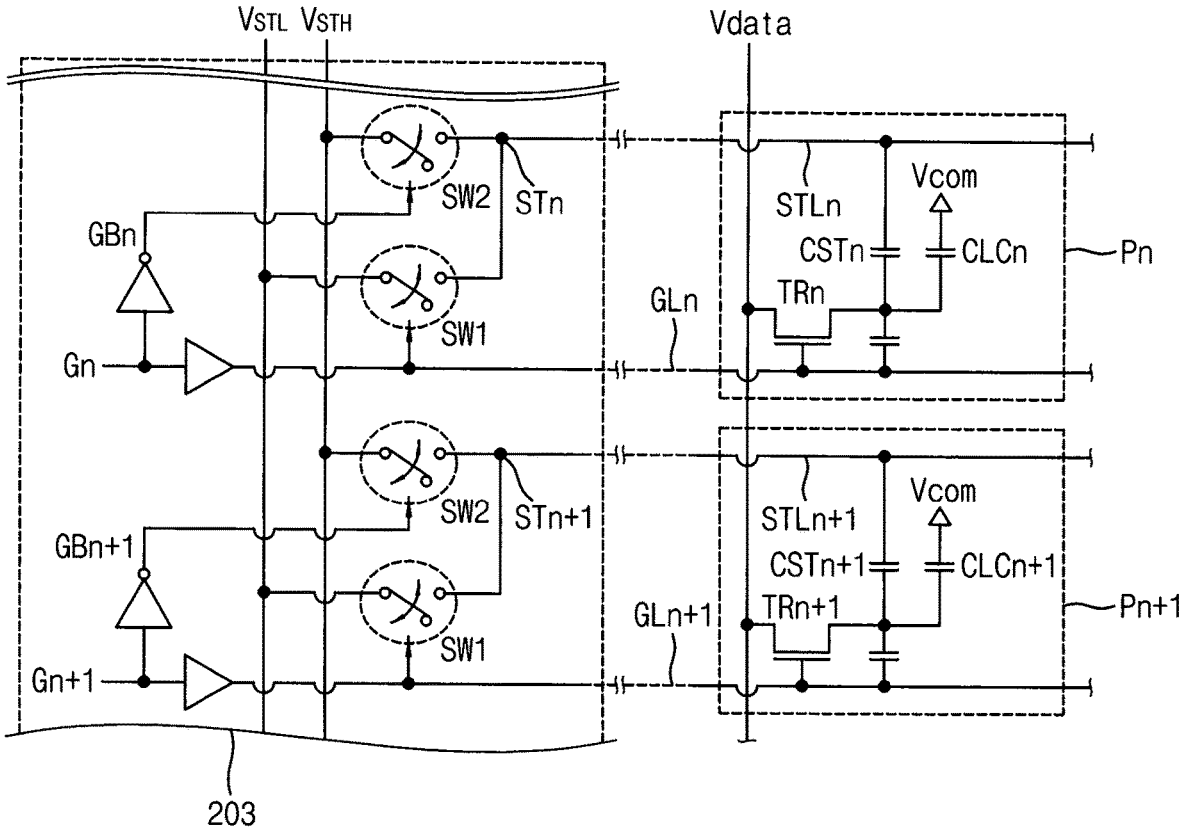
FIG. 5 is a conceptual diagram illustrating an operation of a pixel unit according to an example embodiment.
Figure 6:
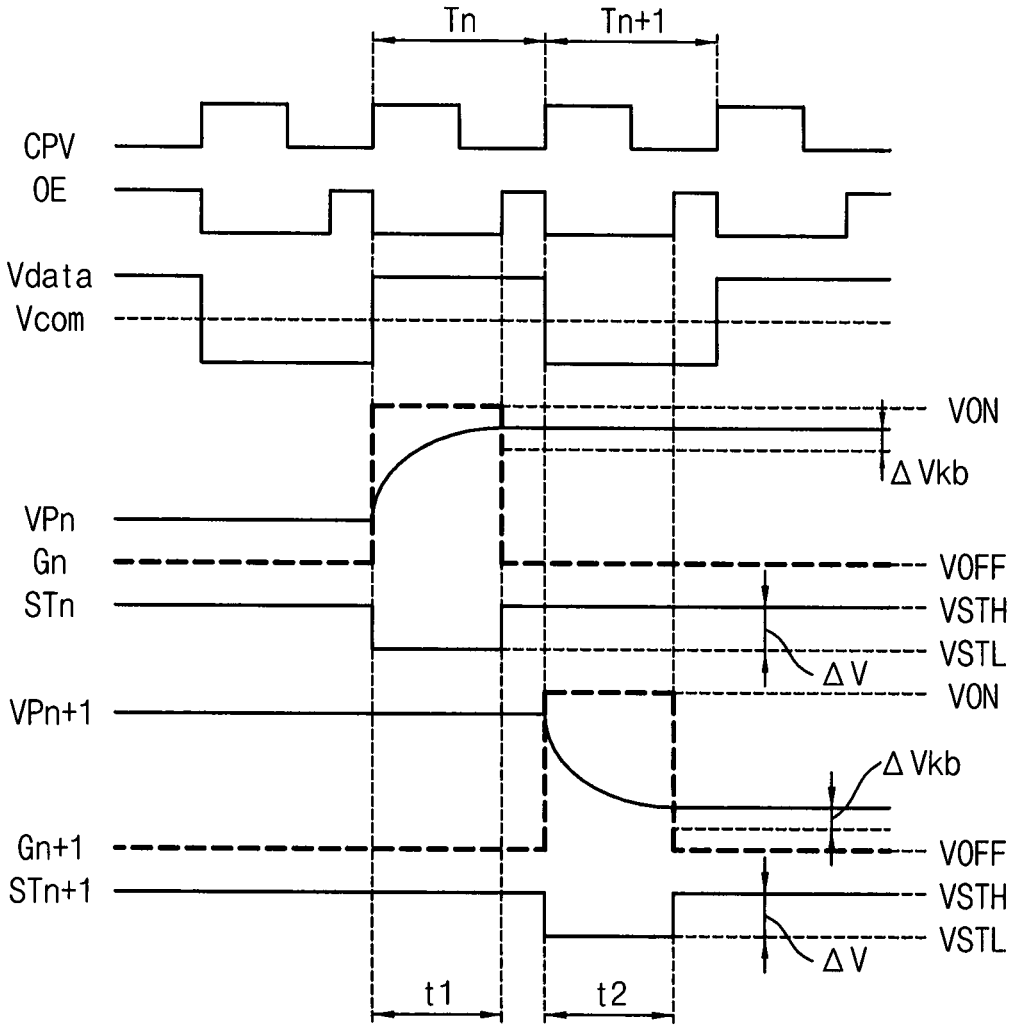
FIG. 6 is a waveform diagram illustrating signals for driving a pixel unit according to an example embodiment.

FIG. 5 is a conceptual diagram illustrating an operation of a pixel unit according to an example embodiment. FIG. 6 is a waveform diagram illustrating signals for driving a pixel unit according to an example embodiment.

Referring to FIGS. 3, 5, and 6, the gate driver circuit 200 may include a level shifter 202 and a level switch 203. The level shifter 202 is configured to generate a plurality of gate signals Gn and Gn+1 based on a gate clock signal CPV and an output enable signal OE.

The level switch 203 is configured to generate a plurality of storage signals STn and STn+1 based on the gate signals Gn and Gn+1, and a plurality of opposite gate signals GBn and GBn+1 having a phase opposite to the gate signals Gn and Gn+1 provided from the level shifter 202. The level switch 203 includes a first switch SW1 and a second switch SW2. The first switch SW1 outputs a storage low voltage VSTL of a low level in response to a gate on voltage of a gate signal and a gate off voltage of an opposite gate signal having a phase opposite to the gate on voltage of the gate signal. The second switch SW2 outputs a storage high voltage VSTH of a high level in response to the gate on voltage of the opposite gate signal and the gate off voltage of the gate signal.

For example, the gate driver circuit 200 respectively outputs an n-th gate signal Gn and an n-th storage signal STn synchronized with the n-th gate signal Gn to an n-th gate line GLn and an n-th storage line STn during an n-th period Tn of a frame period.

For example, an n-th pixel unit Pn includes an n-th pixel transistor TRn, an n-th LC capacitor CLCn, and an n-th storage capacitor CSTn.

The n-th pixel transistor TRn is coupled (e.g., connected) to a data line DL and the n-th gate line GLn. The n-th LC capacitor CLCn includes a first electrode and a second electrode. The first electrode is coupled to the n-th pixel transistor TRn, and receives an n-th data voltage +Vdata having a positive phase (+) with respect to a common voltage Vcom through the data line DL. The second electrode receives the common voltage Vcom.

The n-th storage capacitor CSTn includes a third electrode and a fourth electrode. The third electrode is coupled to the first electrode of the n-th LC capacitor CLCn, and receives the n-th data voltage +Vdata. The fourth electrode is coupled to the n-th storage line STLn, and receives the n-th storage signal STn.

An n-th pixel voltage VPn corresponding to the n-th data voltage +Vdata is charged in the n-th LC capacitor CLCn, and the n-th storage capacitor CSTn maintains the n-th pixel voltage VPn charged in the n-th LC capacitor CLCn during the frame period.

Referring to the n-th pixel voltage VPn charged in the n-th LC capacitor CLCn, the n-th pixel voltage VPn corresponding to the n-th data voltage +Vdata is maintained during a first period t1 during which the n-th gate signal Gn has the gate on voltage VON. Then, the n-th pixel voltage VPn decreases by a kickback voltage ΔVkb at a falling timing when the n-th gate signal Gn drops from the gate on voltage to the gate off voltage VOFF.

During the first period t1, the third electrode of the n-th storage capacitor CSTn receives the n-th data voltage +Vdata, and the fourth electrode receives the storage low voltage VSTL. Thus, the n-th storage capacitor CSTn maintains the n-th pixel voltage VPn corresponding to the n-th data voltage +Vdata. During the falling time of the n-th gate signal Gn, the fourth electrode receives the storage high voltage VSTH that is greater than the storage low voltage VSTL. According to a conservation law of electrical charge of a capacitor, the third electrode of the n-th storage capacitor CSTn has a voltage increased by a swing voltage ΔV between the storage low voltage and the storage high voltage. The swing voltage ΔV may be determined to compensate for the kickback voltage ΔVkb.

Therefore, the first electrode of the n-th LC capacitor CLCn is coupled to the third electrode of the n-th storage capacitor CSTn, and thus, the n-th pixel voltage VPn applied to the first electrode of the n-th LC capacitor CLCn is increased by the swing voltage ΔV. The n-th pixel voltage VPn decreased by the kickback voltage ΔVkb may be compensated by the swing voltage ΔV.

During the frame period after the first period t1, the n-th pixel voltage VPn may be maintained into the n-th data voltage +Vdata by the storage high voltage VSTH applied to the fourth electrode of the n-th storage capacitor CSTn.

Then, the gate driver circuit 200 respectively outputs an (n+1)-th gate signal Gn+1 and an (n+1)-th storage signal STn+1 synchronized with the (n+1)-th gate signal Gn+1 to an (n+1)-th gate line GLn+1 and an (n+1)-th storage line STLn+1 during an (n+1)-th period Tn+1 of the frame period.

For example, an (n+1)-th pixel unit Pn+1 includes an (n+1)-th pixel transistor TRn+1, an (n+1)-th LC capacitor CLCn+1, and an (n+1)-th storage capacitor CSTn+1.

The (n+1)-th pixel transistor TRn+1 is coupled (e.g., connected) to a data line DL and the (n+1)-th gate line GLn+1. The first electrode of the (n+1)-th LC capacitor CLCn+1 is coupled to the (n+1)-th pixel transistor TRn+1, and receives an (n+1)-th data voltage −Vdata having a negative phase (−) with respect to the common voltage Vcom through the (n+1)-th pixel transistor TRn+1. The second electrode of the (n+1)-th LC capacitor CLCn+1 receives the common voltage Vcom.

The third electrode of the (n+1)-th storage capacitor CSTn+1 is coupled to the first electrode of the (n+1)-th LC capacitor CLCn+1, and receives the (n+1)-th data voltage −Vdata. The fourth electrode of the (n+1)-th storage capacitor CSTn+1 is coupled to the (n+1)-th storage line STLn+1, and receives the (n+1)-th storage signal STn+1.

An (n+1)-th pixel voltage VPn+1 corresponding to the (n+1)-th data voltage −Vdata is charged in the (n+1)-th LC capacitor CLCn+1, and the (n+1)-th storage capacitor CSTn+1 maintains the (n+1)-th pixel voltage VPn+1 charged in the (n+1)-th LC capacitor CLCn+1 during the frame period.

Referring to the (n+1)-th pixel voltage VPn+1 charged in the (n+1)-th LC capacitor CLCn+1, the (n+1)-th pixel voltage VPn+1 corresponding to the (n+1)-th data voltage −Vdata is maintained during a second period t2 during which the (n+1)-th gate signal Gn+1 has the gate on voltage VON. Then, the (n+1)-th pixel voltage VPn+1 decreases by a kickback voltage ΔVkb at a falling time when the (n+1)-th gate signal Gn+1 drops from the gate on voltage to the gate off voltage VOFF.

During the second period t2, the third electrode of the (n+1)-th storage capacitor CST n+1 receives the (n+1)-th data voltage −Vdata, and the fourth electrode receives the storage low voltage VSTL. Thus, the (n+1)-th storage capacitor CSTn+1 maintains the (n+1)-th pixel voltage VPn+1 corresponding to the (n+1)-th data voltage −Vdata. During the falling time of the (n+1)-th gate signal Gn+1, the fourth electrode receives the storage high voltage VSTH that is greater than the storage low voltage VSTL. The third electrode of the (n+1)-th storage capacitor CSTn+1 has a voltage increased by the swing voltage ΔV.

Therefore, the third electrode of the (n+1)-th storage capacitor CSTn+1 is coupled to the first electrode of the (n+1)-th LC capacitor CLCn+1, and thus, the (n+1)-th pixel voltage VPn+1 applied to the first electrode of the (n+1)-th LC capacitor CLCn+1 is increased by the swing voltage ΔV. The (n+1)-th pixel voltage VPn+1 dropped by the kickback voltage ΔVkb may be compensated by the swing voltage ΔV.

During the frame period after the second period t2, the (n+1)-th pixel voltage VPn+1 may be maintained into the (n+1)-th data voltage −Vdata by the storage high voltage VSTH applied to the fourth electrode of the (n+1)-th storage capacitor CSTn+1.

According to an example embodiment, the storage voltage is increased by the swing voltage determined to compensate for the kickback voltage at the falling time when the gate signal drops from the gate on voltage to the gate off voltage, and thus, the pixel voltage decreased by the kickback voltage may be compensated.

Figure 7:
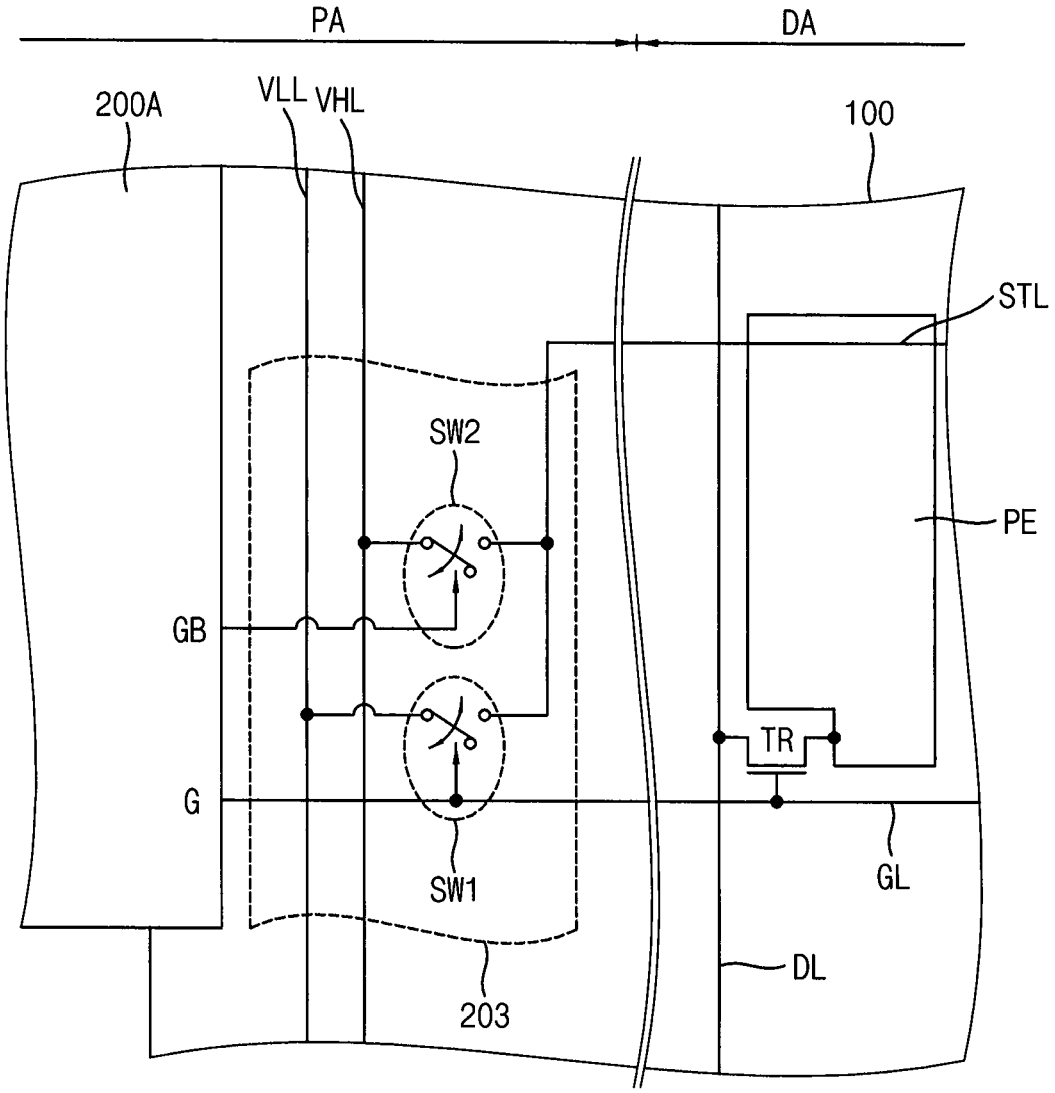
FIG. 7 is a block diagram view schematically showing a display apparatus according to an example embodiment.

FIG. 7 is a block diagram view schematically showing a display apparatus according to an example embodiment.

Hereinafter, the same reference numerals are used to refer to the same or like parts as those described in the previous example embodiments, and thus, detailed description thereof may have been omitted.

Referring to FIG. 7, the display apparatus according to an example embodiment may include a display panel 100, a gate driver circuit 200A, a level switch 203, and a data driver circuit 400.

The display panel 100 may be divided into a display area DA and a peripheral area PA surrounding the display area DA. A plurality of gate lines, a plurality of data lines, and a plurality of pixel units (e.g., pixels) are disposed in the display area DA. Each of the pixel units P include a pixel transistor TR, which is electrically coupled (e.g., electrically connected) to a gate line GL and a data line DL, and a pixel electrode PE, which is electrically coupled to the pixel transistor TR. The pixel electrode PE may correspond to the first electrode of the LC capacitor CLC shown in FIG. 1. Although not shown in the figures, a common electrode receives a common voltage Vcom and may define the LC capacitor CLC with the pixel electrode PE. The storage line STL overlapping the pixel electrode PE may define the storage capacitor CST shown in FIG. 1.

The gate driver circuit 200A may be disposed on the peripheral area PA, such as the TCP, and is configured to generate a plurality of gate signals G to provide the gate lines GL with the gate signals G.

According to an example embodiment, the gate driver circuit 200A is configured to generate a plurality of opposite gate signals GB, and is configured to provide the level switch 203 with the opposite gate signals GB. The opposite gate signal GB has a phase opposite to the gate signal G. For example, the opposite gate signal GB has the gate off voltage during a period in which the gate signal has the gate on voltage, and has the gate on voltage during a period in which the gate signal has the gate off voltage.

The level switch 203 is located (e.g., directly integrated) in the peripheral area. The level switch 203 includes a first voltage line VLL, a second voltage line VHL, a first switch SW1, and a second switch SW2.

The first voltage line VLL transmits a storage low voltage VSTL, and the second voltage line VHL transmits a storage high voltage VSTH.

The first switch SW1 is configured to output the storage low voltage VSTL to the storage line STL in response to the gate on voltage of the gate signal G.

The second switch SW2 is configured to output the storage high voltage VSTH to the storage line STL in response to the gate on voltage of the opposite gate signal GB.

Detailed explanations of the first and second switches SW1 and SW2 are substantially the same as those described in the previous example embodiments referring to FIG. 3, and the repeated descriptions thereof are omitted.

The data driver circuit 400 may be disposed on the peripheral area, such as the TCP, and is coupled (e.g., connected) to the data fines DL. The data driver circuit 400 is configured to output the data signals to the data lines.

According to an example embodiment, the level switch 203, which is configured to generate a storage signal, may be located (e.g., directly integrated) in the peripheral area PA of the display panel 100 via a process that is substantially the same as that for forming the pixel transistor TR (e.g., pixel switching element).

Figure 8:
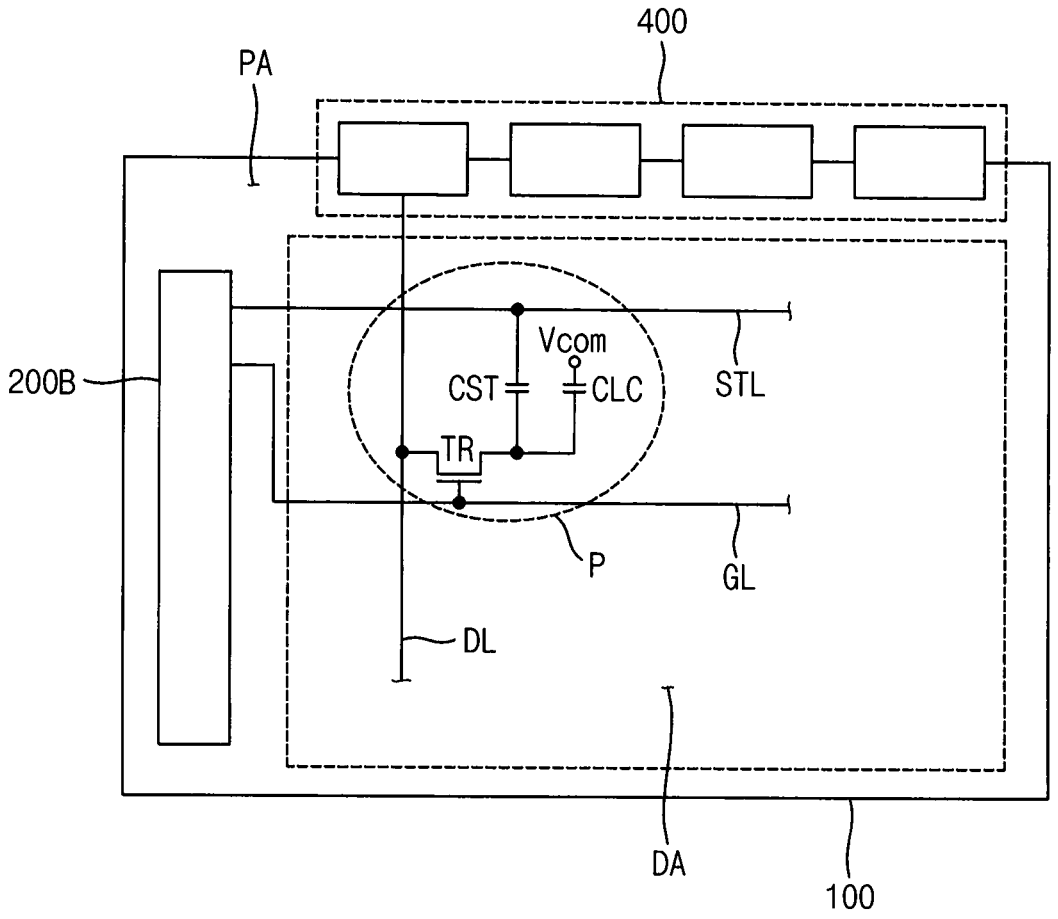
FIG. 8 is a block diagram view schematically showing a display apparatus according to an example embodiment.

FIG. 8 is a block diagram view schematically showing a display apparatus according to an example embodiment.

Hereinafter, the same reference numerals are used to refer to the same or like parts as those described in the previous example embodiments, and thus, detailed description thereof may have been omitted.

Referring to FIG. 8, the display apparatus according to an example embodiment may include a display panel 100, a gate driver circuit 200B, and a data driver circuit 400.

The display panel 100 may be divided into a display area IDA and a peripheral area PA surrounding the display area DA. A plurality of gate lines, a plurality of data lines, and a plurality of pixel units (e.g., pixels) are disposed in the display area DA. Each of the pixel units P includes a pixel transistor TR, which is electrically coupled (e.g., electrically connected) to a gate line GL and a data line DL, a liquid crystal capacitor CLC, which is electrically coupled to the pixel transistor TR, and a storage capacitor CST, which is electrically coupled to the liquid crystal capacitor CLC.

The gate driver circuit 200B is located (e.g., directly integrated) in the peripheral area PA of the display panel 100 via the process substantially the same as that of forming the pixel transistor TR.

The gate driver circuit 200B is coupled (e.g., connected) to the gate lines GL and the storage lines STL.

The gate driver circuit 200B is configured to generate a plurality of gate signals, which is respectively applied to the gate lines GL, and a plurality of storage signals, which is respectively applied to the storage lines STL and is synchronized with the gate signals. Each of the storage signals is synchronized with each of the gate signals and has a phase opposite to that of each of the gate signals. For example, the storage signal has a storage low voltage during a period in which the gate signal has a gate on voltage, and has a storage high voltage during a period in which the gate signal has a gate off voltage.

The gate driver circuit 200B is configured to sequentially output the gate signals to the gate lines GL, and to sequentially output the storage signals to the storage lines STL.

The data driver circuit 400 may be disposed on the peripheral area, such as the TCP, and is coupled to the data lines DL. The data driver circuit 400 is configured to output the data signals to the data lines.

Figure 9:
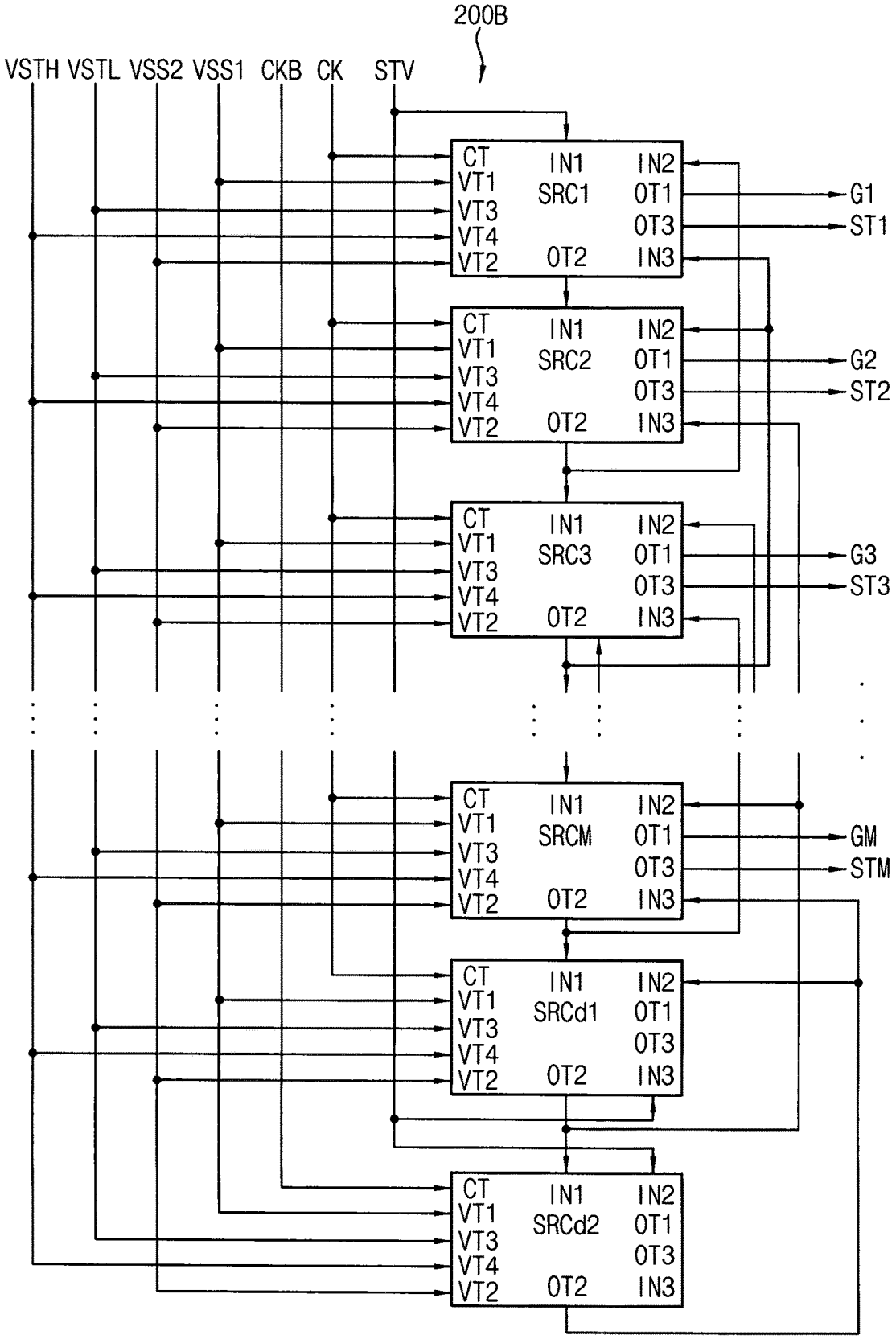
FIG. 9 is a block diagram illustrating a gate driver circuit shown in FIG. 8.

FIG. 9 is a block diagram illustrating the gate driver circuit shown in FIG. 8.

Referring to FIGS. 8 and 9, the gate driver circuit 200B includes a shift register including first to M-th (non-dummy) stages SCR1 to SRCM that are cascade-coupled (e.g., cascade-connected) to each other, a first dummy stage SRCd1, and a second dummy stage SRCd2. In this embodiment, 'M' is a natural number.

The first to M-th stages SRC1 to SRCM are respectively coupled to m gate lines to sequentially provide the gate lines with first to M-th gate signals G1, G2, . . . , GM. The first dummy stage SRCd1 helps to control driving of an (M−1)-th stage SRCM−1 and the M-th stage SRCM. The second dummy stage SRCd2 helps to control driving of the M-th stage SRCM and the first dummy stage STCd1. The first and second dummy stages SRCd1 and SRCd2 are not coupled (e.g., directly coupled) to any of the gate lines.

Each of the stages includes a clock terminal CT, a first input terminal IN1, a second input terminal IN2, a third input terminal IN3, a first voltage terminal VT1, a second voltage terminal VT2, a third voltage terminal VT3, a fourth voltage terminal VT4, a first output terminal OT1, a second output terminal OT2, and a third output terminal OT3.

The clock terminal CT receives a first clock signal or a second clock signal different from the first clock signal. For example, the second clock signal may have a phase opposite to that of the first clock signal. Hereinafter, the first clock signal may be referred to as a clock signal CK, and the second clock signal may be referred to as an inversion clock signal CKB.

For example, the clock terminals CT of odd-numbered stages SRC1, SRC3, . . . , SRCd1 receive the clock signal CK, and the clock terminals CT of even-numbered stages SRC2, SRC4, . . . , SRCd2 receive the inversion clock signal CKB. The clock signal CK and the inversion clock signal CKB may alternate periodically between a high voltage VDD and a first low voltage VSS1.

The first input terminal IN1 receives a vertical start signal STV or a carry signal outputted from at least one of previous stages of the n-th stage. The first input terminal IN1 of the first stage SRC1 receives a vertical start signal STV. The first input terminal IN1 of the second to second dummy stages SRC2 to SRCd2 receives a carry signal outputted from at least one of the previous stages. For example, the first input terminal IN1 of the n-th stage receives an (n−1)-th carry signal CRn−1 of an (n−1)-th stage.

The second input terminal IN2 receives a carry signal outputted from at least one of next stages or the vertical start signal STV. The second input terminal IN2 of the first stage to first dummy stages SRC1 to SRCd1 receives the carry signal outputted from at least one of the next stages. For example, the second input terminal IN2 of the n-th stage receives an (n+1)-th carry signal CRn+1 of an (n+1)-th stage. The second input terminal IN2 of the second dummy stage SRCd2, that is a last stage, receives the vertical start signal STV. The second input terminal IN2 of the second dummy stage SRCd2 may receive the vertical start signal STV of a next frame period.

The third input terminal IN3 receives a carry signal outputted from at least one of next stages or the vertical start signal STV. The third input terminal IN3 of the first stage to M-th stages SRC1 to SRCM receives the carry signal outputted from at least one of the next stages. The third input terminal IN3 of the first dummy stage SRCd1 receives the vertical start signal STV. For example, the third input terminal IN3 of the n-th stage receives an (n+2)-th carry signal CRn+2 of an (n+2)-th stage.

The first voltage terminal VT1 receives the first low voltage VSS1. The first low voltage VSS1 has a first low level, and the first low level may correspond to a low level of the gate signal. For example, the first low level may be about −6 V.

The second voltage terminal VT2 receives a second low voltage VSS2, which has a second low level less than that of the first low level VSS1. The second low level may correspond to a low level of the control node Qn in the stage. For example, the second low level may be about −10 V.

The third voltage terminal VT3 receives the storage low voltage VSTL.

The fourth voltage terminal VT4 receives the storage high voltage VSTH. One of the storage low voltage VSTL and the storage high voltage VSTH may be equal or substantially equal to the common voltage Vcom. The swing voltage ΔV between the storage low voltage VSTL and the storage high voltage VSTH may be determined to compensate for the kickback voltage ΔVkb.

The first output terminals OT1 output the gate signals and are coupled to the gate lines. The first output terminals OT1 of the first stage to M-th stages SRC1 to SRCM respectively output first to m-th gate signals G1, G2, . . . , GM. The first output terminal OT1 of the first and second dummy stages SRCd1 and SRCd2 do not output the gate signal.

The second output terminals OT2 output the carry signals. The second output terminal OT2 is coupled to the first input terminal IN1 of at least one of the next stages, and to the second and third input terminals IN2 and IN3 of at least two of the previous stages.

The third output terminals OT3 are coupled to the storage line and output storage signals. The third output terminals OT3 of first and second dummy stages SRCd1 and SRCd2 do not output the storage signals.

Figure 10:
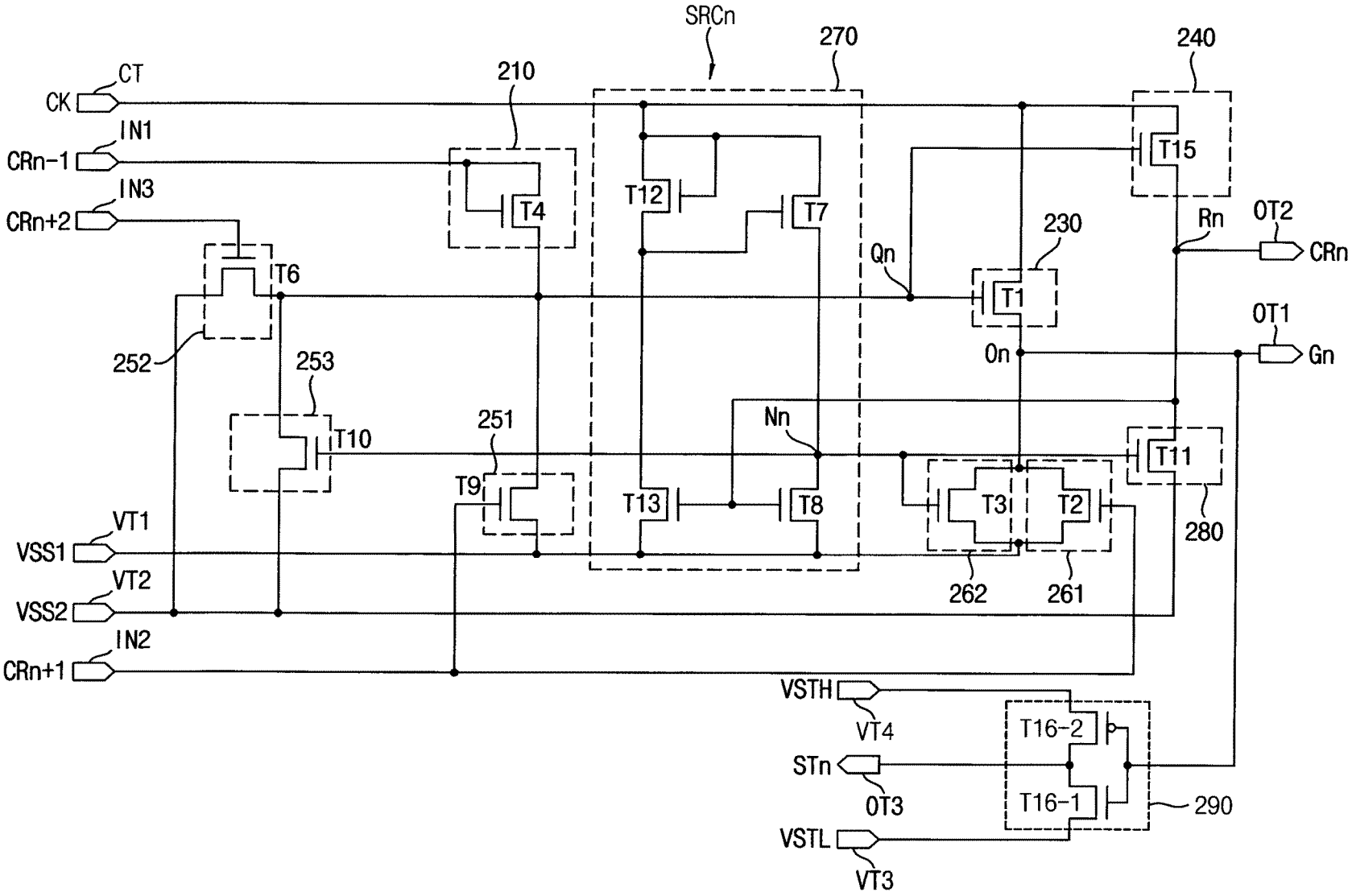
FIG. 10 is a circuit diagram illustrating a stage shown in FIG. 9.
Figure 11:
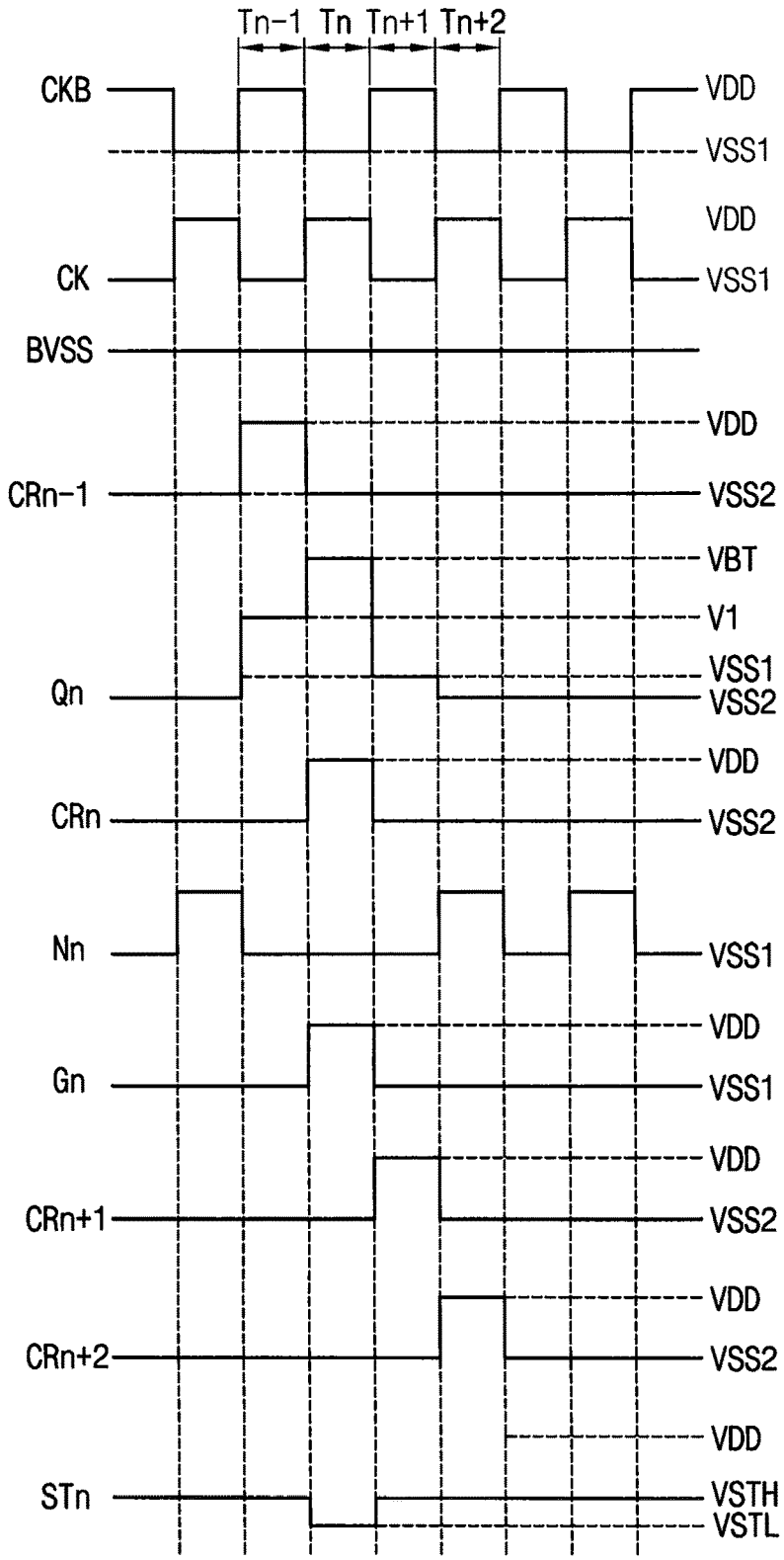
FIG. 11 is a waveform diagram showing signals of the stage shown in FIG. 10.

FIG. 10 is a circuit diagram illustrating a stage of FIG. 9. FIG. 11 is a waveform diagram showing signals of the stage shown in FIG. 10.

Referring to FIGS. 10 and 11, an n-th stage SRCn includes a buffer part 210, a pull-up part 230, a carry part 240, a first control pull-down part 251, a second control pull-down part 252, a control holding part 253, an output pull-down part 261, an output holding part 262, an inverter 270, a carry holding part 280, and a level switch part 290.

The buffer part 210 transfers an (n−1)-th carry signal CRn−1 to the pull-up part 230. The buffer part 210 may include a fourth transistor T4. The fourth transistor T4 includes a control electrode and an input electrode, which are coupled to the first input terminal IN1, and an output electrode, which is coupled to a control node Qn.

When the buffer part 210 receives a high voltage VDD of the (n−1)-th carry signal CRn−1, the control node Qn receives a first voltage V1 corresponding to the high voltage VDD.

The pull-up part 230 outputs an n-th gate signal Gn. The pull-up part 230 may include a first transistor T1. The first transistor T1 includes a control electrode, which is coupled to the control node Qn, an input electrode, which is coupled to the clock terminal CT, and an output electrode, which is coupled to an output node On. The output node On is coupled to the first output terminal OT1.

In a state in which the first voltage V1 of the control node Qn is applied to a control electrode of the pull-up part 230, the clock terminal CT receives a high voltage VDD of the clock signal CK, and the control node Qn is boosted up to a boosted voltage VBT greater than the first voltage V1. Thus, the control node Qn has the first voltage V1 during an (n−1)-th period Tn−1, and has the boosted voltage VBT during an n-th period Tn.

During the n-th period Tn in which the boosted voltage VBT is applied to the control electrode of the pull-up part 230, the pull-up part 230 outputs a high voltage VDD of an n-th gate signal Gn using a high voltage VDD of the clock signal CK. The n-th gate signal Gn is outputted through the first output terminal OT1 coupled to the output node On.

The carry part 240 outputs an n-th carry signal CRn. The carry part 240 may include a fifteenth transistor T15. The fifteenth transistor T15 includes a control electrode, which is coupled to the control node Qn, an input electrode, which is coupled to the clock terminal CT, and an output electrode, which is coupled to a carry node Rn. The carry node Rn is coupled to a second output terminal OT2.

When a high voltage is applied to the control node Qn, the carry part 240 outputs a high voltage VDD of the clock signal CK (received from the clock terminal CT) as an n-th carry signal CRn. The n-th carry signal CRn is outputted through the second output terminal OT2 coupled to the carry node Rn of the n-th stage SRCn.

The first and second control pull-down parts 251 and 252 sequentially pull-down a voltage of the control node Qn into the first and second low voltages VSS1 and VSS2 in response to the (n+1)-th carry signal CRn+1 and the (n+2)-th carry signal CRn+2.

The first control pull-down part 251 may include a ninth transistor T9. The ninth transistor T9 includes a control electrode, which is coupled to the second input terminal IN2, an input electrode, which is coupled to the control node Qn, and an output electrode which is coupled to the first voltage terminal VT1.

When the second input terminal IN2 receives a high voltage VDD of the (n+1)-th carry signal CRn+1 during an (n+1)-th period Tn+1, the ninth transistor T9 pulls-down a voltage of the control node Qn to the first low voltage VSS1 (received from the first voltage terminal VT1). The control electrode of the ninth transistor T9 receives the second low voltage VSS2 (e.g., −10V), that is, a low voltage of the (n+1)-th carry signal CRn+1 during a remaining period of a frame period except for the (n+1)-th period Tn+1.

The second control pull-down part 252 may include a sixth transistor T6. The sixth transistor T6 includes a control electrode, which is coupled to the third input terminal IN3, an input electrode, which is coupled to the control node Qn, and an output electrode, which is coupled to the second voltage terminal VT2.

When the third input terminal IN3 receives a high voltage VDD of the (n+2)-th carry signal CRn+2 during an (n+2)-th period Tn+2, the sixth transistor T6 pulls-down a voltage of the control node Qn to the second low voltage VSS2 (received from the second voltage terminal VT2). The control electrode of the sixth transistor T6 receives the second low voltage VSS2 (e.g., −10V), that is, the low voltage of the (n+2)-th carry signal CRn+2 during a remaining period of a frame period except for the (n+2)-th period Tn+2.

The control holding part 253 maintains the voltage of the control node Qn to the second low voltage VSS2. The control holding part 253 may include a tenth transistor T10. The tenth transistor T10 includes a control electrode, which is coupled to the inverter node Nn, an input electrode, which is coupled to the control node Qn, and an output electrode, which is coupled to the second voltage terminal VT2. The control holding part 253 maintains the voltage of the control node Qn to the second low voltage VSS2 in response to a voltage of the inverter node Nn during a remaining period of the frame period.

The output pull-down part 261 pulls-down the n-th gate signal Gn to the first low voltage VSS1. The output pull-down part 261 may include a second transistor T2. The second transistor T2 includes a control electrode, which is coupled to the second input terminal IN2, an input electrode, which is coupled to the output node On, and an output electrode, which is coupled to the first voltage terminal VT1. When the second input terminal IN2 receives a high voltage VDD of the (n+1)-th carry signal CRn+1, the output pull-down part 261 pulls-down the voltage of the output node On to the first low voltage VSS1 (received from the first voltage terminal VT1).

The output holding part 262 maintains the voltage of the output node On to the first low voltage VSS1. The output holding part 262 may include a third transistor T3. The third transistor T3 includes a control electrode, which is coupled to the inverter node Nn, an input electrode, which is coupled to the output node On, and an output electrode, which is coupled to the first voltage terminal VT1. The output holding part 262 maintains the voltage of the output node On to the first low voltage VSS1 (received from the first voltage terminal VT1) in response to a signal of the inverter node Nn during a remaining period of the frame period.

The inverter 270 applies a signal, which has a phase identical to or substantially the same as that of the clock signal CK received at the clock terminal CT, to the inverter node Nn during a remaining period of the frame period except the n-th period Tn. The inverter 270 may include a twelfth transistor T12, a seventh transistor T7, a thirteenth transistor T13, and an eighth transistor T8.

During the n-th period Tn of the frame period in which a high voltage is applied to the carry node Rn, the inverter 270 discharges the clock signal CK received from the clock terminal CT into the first low voltage VSS1 received from the first voltage terminal VT1. The eighth and thirteenth transistors T8 and T13 are turned-on in response to a high voltage of the carry node Rn. Accordingly, the clock signal CK is discharged into the first low voltage VSS1 during the n-th period Tn.

The carry holding part 280 maintains a voltage of the carry node Rn to the second low voltage VSS2. The carry holding part 280 may include an eleventh transistor T11. The eleventh transistor T11 includes a control electrode, which is coupled to the inverter node Nn, an input electrode, which is coupled to the carry node Rn, and an output electrode, which is coupled to the second voltage terminal VT2. The carry holding part 280 maintains the voltage of the carry node Rn to the second low voltage VSS2 (received from the second voltage terminal VT2), in response to the signal of the inverter node Nn during a remaining period of the frame period except for the n-th period Tn.

The level switching part 290 includes (16-1)-th transistor T16-1, which is an N-type transistor, and a (16-2)-th transistor T16-2, which is a P-type transistor. The (16-1)-th transistor T16-1 includes a control electrode, which is coupled to the output node On, an input electrode, which is coupled to the third voltage terminal VT3, and an output electrode, which is coupled to the third output terminal OT3. The (16-2)-th transistor T16-2 includes a control electrode, which is coupled to the output node On, an input electrode, which is coupled to the fourth voltage terminal VT4, and an output electrode, which is coupled to the third output terminal OT3.

When the high voltage VDD of the n-th gate signal Gn is applied to the output node On, the (16-1)-th transistor T16-1 is turned on, and the (16-2)-th transistor T16-2 is turned off. Thus, the storage low voltage VSTL received from the third voltage terminal VT3 is outputted through the third output terminal OT3. When the first low voltage VSS1 of the n-th gate signal Gn is applied to the output node On, the (16-1)-th transistor T16-1 is turned off, and the (16-2)-th transistor T16-2 is turned on. Thus, the storage high voltage VSTH received from the fourth voltage terminal VT4 is outputted through the third output terminal OT3.

Therefore, the third output terminal OT3 outputs the n-th storage signal STn that is synchronized with the n-th gate signal Gn.

According to an example embodiment, the gate driver circuit that is configured to generate the gate signal and the storage signal may be located (e.g., directly integrated) in the peripheral area PA via the process substantially the same as that of forming the pixel transistor TR. Thus, the display apparatus may have a narrow bezel.

Figure 12:
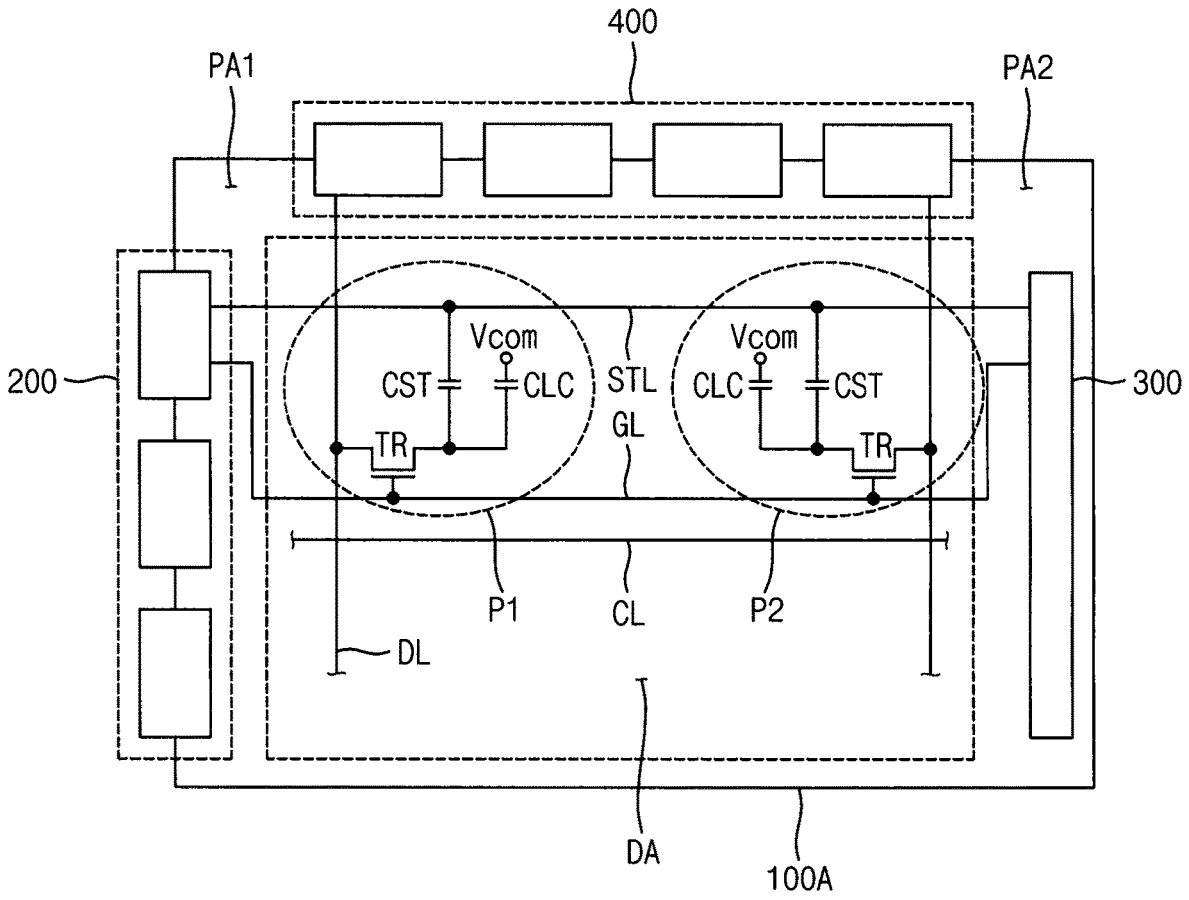
FIG. 12 is a block diagram view schematically showing a display apparatus according to an example embodiment.

FIG. 12 is a block diagram view schematically showing a display apparatus according to an example embodiment.

Hereinafter, the same reference numerals are used to refer to the same or like parts as those described in the previous example embodiments, and thus, detailed description thereof may have been omitted.

Referring to FIG. 12, the display apparatus according to an example embodiment includes a display panel 100A, a gate driver circuit 200, a second level switch 300, and a data driver circuit 400.

The display panel 100A may be divided into a display area DA and a peripheral area PA surrounding the display area DA. A plurality of gate lines, a plurality of data lines, and a plurality of pixel units (e.g., pixels) are disposed in the display area DA.

According to an example embodiment, the display panel 100A may further include a plurality of control lines CL, which are adjacent to the gate lines GL and are disposed in parallel with the gate lines GL.

Each of the pixel units P include a pixel transistor TR, which is electrically coupled (e.g., electrically connected) to a gate line GL and a data line DL, a liquid crystal capacitor CLC, which is electrically coupled to the pixel transistor TR, and a storage capacitor CST, which is electrically coupled to the liquid crystal capacitor CLC.

The gate driver circuit 200 is disposed in a first peripheral area PA1 of the peripheral area PA, which is adjacent to a first end portion of the gate line GL. The gate driver circuit 200 is substantially the same as that described in the previous example embodiment referring to FIGS. 2 and 3.

Referring to FIGS. 2, 3, and 12, the gate driver circuit 200 is configured to generate a plurality of gate signals G1, . . . , GM, and to output the gate signals G1, . . . , GM to the gate lines GL. In addition, the gate driver circuit 200 includes a first level switch 203, which is configured to generate a plurality of first storage signals ST1, . . . , STM, and to output the first storage signals ST1, . . . , STM to the storage lines STL.

Each of the storage signals ST1, . . . , STM is synchronized with each of the gate signals G1, . . . , GM, and has a phase opposite to each of the gate signals G1, . . . , GM. For example, the storage signal has a first storage low voltage during a period in which the gate signal has a gate on voltage, and has a storage high voltage during a period in which the gate signal has a gate off voltage.

A first swing voltage ΔV1 between the first storage low voltage and the storage high voltage may compensate for a pixel voltage of a first pixel unit P1 dropped by a first kickback voltage ΔVkb1 of the first pixel unit P1 adjacent to the gate driver circuit 200. The storage high voltage may be substantially the same as the common voltage Vcom of the LC capacitor CLC.

According to an example embodiment, the gate driver circuit 200 is coupled (e.g., connected) to the control lines CL in the display panel 100A, and is configured to output the opposite gate signals, which have a phase opposite to that of the gate signals, to the control lines CL.

The second level switch 300 is located (e.g., directly integrated) in a second peripheral area PA2 of the peripheral area PA adjacent to a second end portion of the gate line. The second level switch 300 is configured to generate a plurality of second storage signals using the gate signals and the opposite gate signals, and to output the second storage signals to the storage lines STL.

Each of the storage signals ST1, . . . , STM is synchronized with each of the gate signals, and has a phase opposite to that of its corresponding one of the gate signals. For example, the storage signal has a second storage low voltage during a period in which the gate signal has a gate on voltage, and has a storage high voltage during a period in which the gate signal has a gate off voltage.

A second swing voltage ΔV2 between the second storage low voltage and the storage high voltage may compensate for a pixel voltage of a second pixel unit P2 dropped by a second kickback voltage ΔVkb2 of the second pixel unit P2, which is far away from to the gate driver circuit 200 and is adjacent to the second level switch 300. The second storage low voltage is greater than the first storage low voltage.

A level of the gate signal applied to the second pixel unit P2, which is far away from the gate driver circuit 200, is less than a level of the gate signal applied to the first pixel unit P1, which is adjacent to the gate driver circuit 200, by the RC delay of the gate signal. Thus, the second kickback voltage ΔVkb2 of the second pixel unit P2 is less than the first kickback voltage ΔVkb1 of the first pixel unit P1. The second swing voltage ΔV2 corresponding to the second kickback voltage ΔVkb2 is less than the first swing voltage ΔV1 corresponding to the first kickback voltage ΔVkb1, and thus, the second storage low voltage is greater than the first storage low voltage.

However, during a period in which the pixel voltage is maintained, the same storage high voltage is applied to the first pixel unit P1 and the second pixel unit P2, and thus, a current path may not be formed between the first pixel unit P1 and the second pixel unit P2.

The data driver circuit 400 may be disposed on the peripheral area, such as the TCP, and is coupled to the data lines DL. The data driver circuit 400 is configured to output the data signals to the data lines.

According to an example embodiment, the first pixel unit adjacent to the gate driver circuit 200 may be compensated for the kickback voltage by the first level switch 203 in the gate driver circuit 200, and the second pixel unit far away from the gate driver circuit 200 may be compensated for the kickback voltage by the second level switch 300, and thus, difference kickback voltages according to the RC delay of the gate signal may be easily compensated.

Figure 13:
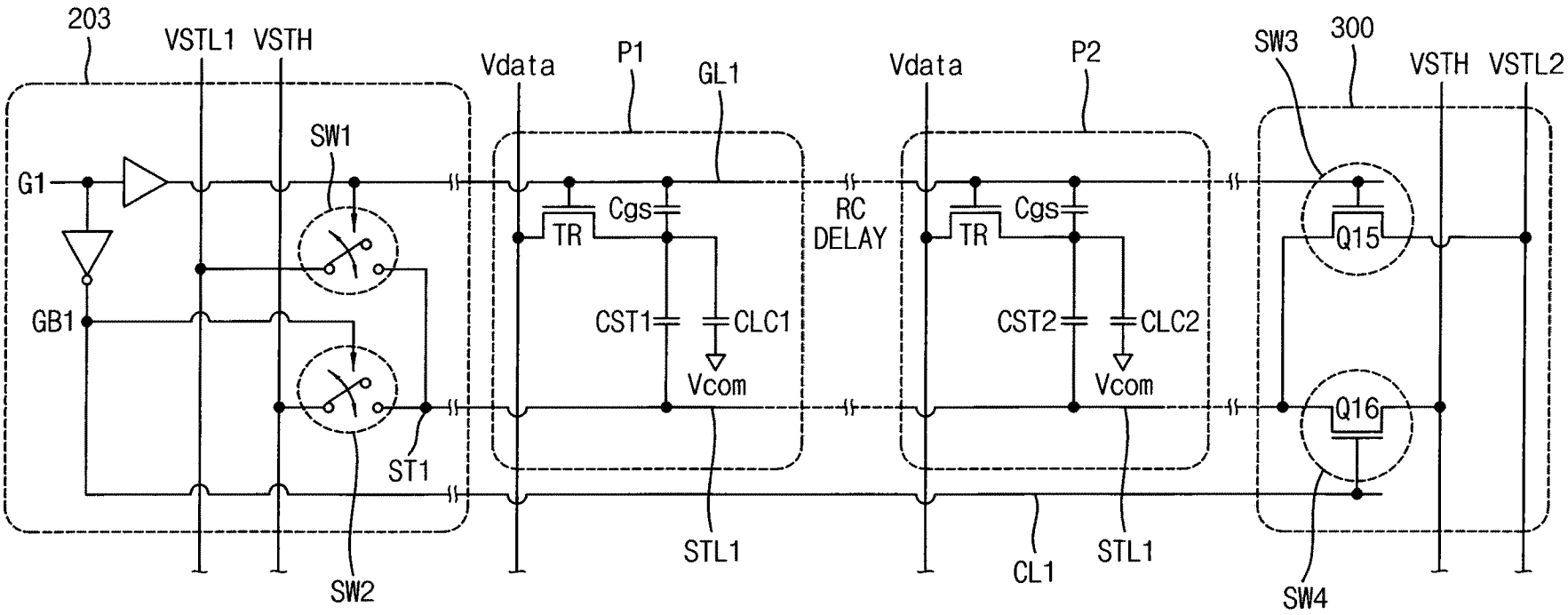
FIG. 13 is a conceptual diagram illustrating first and second level switches shown in FIG. 12.

FIG. 13 is conceptual diagram illustrating first and second level switches shown in FIG. 12.

Hereinafter, the same reference numerals are used to refer to the same or like parts as those described in the previous example embodiments, and thus, detailed description thereof may have been omitted.

Referring to FIG. 13, the gate driver circuit 200 is substantially the same as that described in the previous example embodiment referring to FIGS. 2 and 3.

The gate driver circuit 200 includes a level shifter 202 and a first level switch 203 as shown in FIGS. 2 and 3. The level shifter 202 is configured to generate a plurality of gate signals based on the gate clock signal CPV. In addition, the level shifter 202 is configured to generate a plurality of opposite gate signals having a phase opposite to that of the gate signals.

The level switch 203 includes a first switch SW1 and a second switch SW2. The level switch 203 is configured to generate a plurality of storage signals based on the gate signals and the opposite gate signals received from the level shifter 202, and to output a plurality of storage signals to a plurality of storage lines.

For example, the first switch SW1 outputs a first storage low voltage VSTL1 of a low level, in response to a gate on voltage of a first gate signal G1 and a gate off voltage of a first opposite gate signal GB1 having a phase opposite to that of the gate on voltage of the first gate signal G1, to a first storage line STL1. The second switch SW2 outputs a storage high voltage VSTH of a high level, in response to the gate on voltage of the first opposite gate signal GB1 and the gate off voltage of the first gate signal G1, to the first storage line STL1.

Therefore, a first storage capacitor CST1 of the first pixel unit P1 adjacent to the gate driver circuit 200 receives a (1-1)-th storage signal having the first storage low voltage VSTL1 and the storage high voltage VSTH.

The second level switch 300 includes a third switch SW3 and a fourth switch SW4.

The third switch SW3 includes a fifteenth transistor Q15. The fifteenth transistor Q15 includes a control electrode, which is coupled to the first gate line GL1, an input electrode, which receives a second storage low voltage VSTL2, and an output electrode, which is coupled to the first storage line STL1.

The third switch SW3 turns on in response to the gate on voltage of the first gate signal G1 applied to the first gate line GL1, and thus, the second storage low voltage VSTL2 is applied to the first storage line STL1.

The fourth switch SW4 includes a sixteenth transistor Q16. The sixteenth transistor Q16 includes a control electrode, which is coupled to a first control line CL1, an input electrode, which receives the storage high voltage VSTH, and an output electrode, which is coupled to the first storage line STL1.

The fourth switch SW4 turns on in response to the gate on voltage of the first opposite gate signal GB1 applied to the first control line CL1, and thus, the storage high voltage VSTH is applied to the first storage line STL1.

Therefore, a second storage capacitor CST2 of the second pixel unit P2, far away from the gate driver circuit 200, receives a (1-2)-th storage signal having the second storage low voltage VSTL2 and the storage high voltage VSTH from the second level switch 300.

Figure 14:
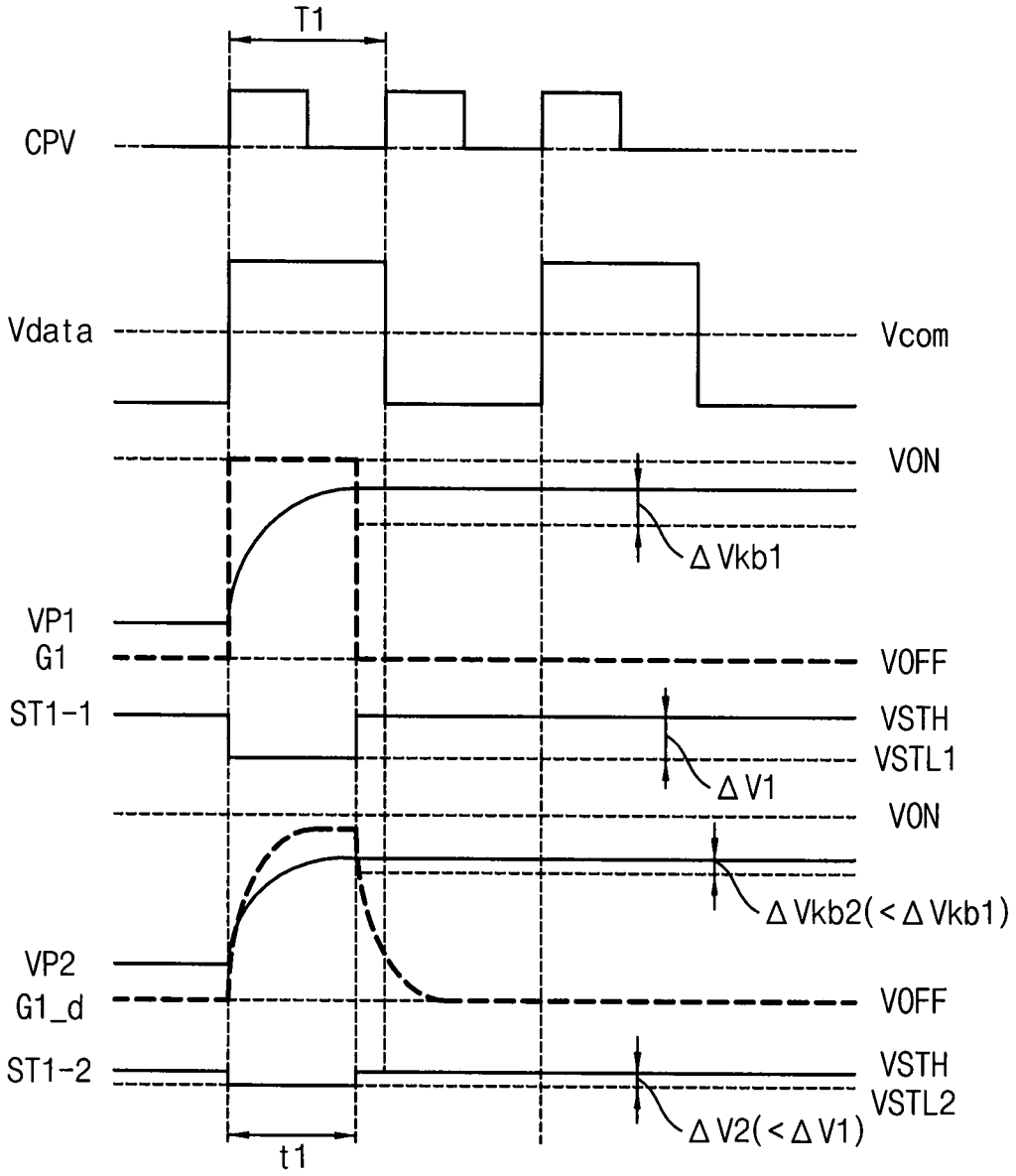
FIG. 14 is a waveform diagram showing signals for driving first and second pixel units by the gate driver circuit and the first and second level switches shown in FIG. 13.

FIG. 14 is a waveform diagram showing signals for driving first and second pixel units by the gate driver circuit and the first and second level switches shown in FIG. 13.

Referring to FIGS. 13 and 14, the gate driver circuit 200 outputs a first gate signal G1 to a first gate line GL1 during a first period T1 of a frame period. The gate driver circuit 200 outputs a (1-1)-th storage signal ST1-1 having the first storage low voltage VSTL1 and the storage high voltage VSTH during the first period T1.

A first LC capacitor CLC1 of the first pixel unit P1, which is adjacent to the gate driver circuit 200, charges a first pixel voltage VP1 corresponding to a data voltage +Vdata in response to the first gate signal G1, and a first storage capacitor CST1 of the first pixel unit P1 maintains the first pixel voltage VP1 charged in the first LC capacitor CLC1 during the frame period.

Referring to the first pixel voltage VP1 charged in the first LC capacitor CLC1, the first pixel voltage VP1 corresponding to the data voltage +Vdata is maintained during a first period t1 during which the first gate signal G1 has the gate on voltage VON. Then, the first pixel voltage VP1 decreases by a first kickback voltage ΔVkb1 at a falling timing when the first gate signal G1 drops from the gate on voltage VON to the gate off voltage VOFF.

During the first period t1, the first storage capacitor CST1 receives the data voltage +Vdata and the first storage low voltage VSTL1. Thus, the first storage capacitor CST1 maintains the first pixel voltage VP1 corresponding to the data voltage +Vdata. In the falling timing of the first gate signal G1, the first storage capacitor CST1 receives the storage high voltage VSTH that is greater than the first storage low voltage VSTL1. Thus, the first storage capacitor CST1 has a voltage increased by a first swing voltage ΔV1 between the first storage low voltage VSTL1 and the storage high voltage VSTH.

Therefore, the increased voltage by the first swing voltage ΔV1 is applied to the first LC capacitor CLC1, which is coupled to the first storage capacitor CST1, and thus, the first pixel voltage VP1 decreased by the first kickback voltage ΔVkb1 may be compensated by the first swing voltage ΔV1.

The first level switch 300 outputs a (1-2)-th storage signal ST1-2 having to the second storage low voltage VSTL2 and the storage high voltage VSTH during the first period T1.

A second LC capacitor CLC2 of the second pixel unit P2, which is far away from the gate driver circuit 200, charges a second pixel voltage VP2 corresponding to a data voltage +Vdata in response to a delayed first gate signal G1_*d*, and a second storage capacitor CST2 of the second pixel unit P2 maintains the second pixel voltage VP2 charged in the second storage capacitor CST2 during the frame period.

Referring to the second pixel voltage VP2 charged in the second LC capacitor CLC2, the second pixel voltage VP2 corresponding to the data voltage +Vdata is maintained during a first period t1 during which the delayed first gate signal G1_*d* has the gate on voltage VON. Then, the second pixel voltage VP2 decreases by a kickback voltage ΔVkb at a falling timing when the delayed first gate signal G1_*d* drops from the gate on voltage VON to the gate off voltage VOFF. The second kickback voltage ΔVkb2 of the second pixel unit P2 is less than the first kickback voltage ΔVkb1 of the first pixel unit P1.

During the first period t1, the second storage capacitor CST2 receives the data voltage +Vdata and the second storage low voltage VSTL2. Thus, the second storage capacitor CST2 maintains the second pixel voltage VP2 corresponding to the data voltage +Vdata. During the falling time of the delayed first gate signal G1, the second storage capacitor CST2 receives the storage high voltage VSTH that is greater than the second storage low voltage VSTL2. Thus, the second storage capacitor CST2 has a voltage increased by a second swing voltage ΔV2 between the second storage low voltage VSTL2 and the storage high voltage VSTH.

Therefore, the increased voltage by the second swing voltage ΔV2 is applied to the second LC capacitor CLC2, which is coupled to the second storage capacitor CST2, and thus, the second pixel voltage VP2 decreased by the second kickback voltage ΔVkb2 may be compensated by the second swing voltage ΔV2.

According to an example embodiment, the first pixel unit P1 adjacent to the gate driver circuit 200 may be compensated for the kickback voltage by the first level switch 203 in the gate driver circuit 200, and the second pixel unit P2 far away from the gate driver circuit 200 may be compensated for the kickback voltage by the second level switch 300, and thus, difference kickback voltages according to the RC delay of the gate signal may be easily compensated.

Figure 15:
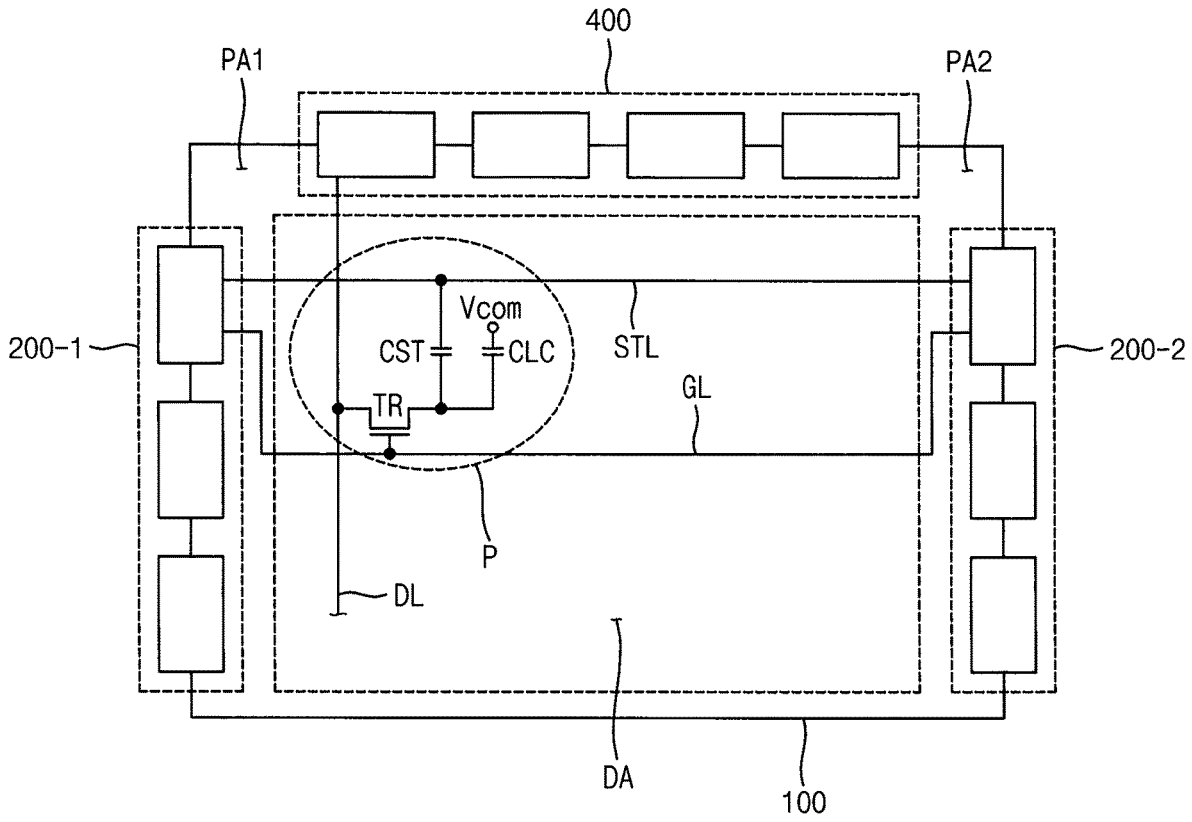
FIG. 15 is a block diagram view schematically showing a display apparatus according to an example embodiment.

FIG. 15 is a block diagram view schematically showing a display apparatus according to an example embodiment.

Hereinafter, the same reference numerals are used to refer to the same or like parts as those described in the previous example embodiments, and thus, detailed description thereof may have been omitted.

Referring to FIG. 15, the display apparatus according to an example embodiment includes a display panel 100, a first gate driver circuit 200-1, a second gate driver circuit 200-2, and a data driver circuit 400.

The display panel 100 may be divided into a display area DA and a peripheral area PA surrounding the display area DA. A plurality of gate lines, a plurality of data lines, and a plurality of pixel units (e.g., pixels) are disposed in the display area DA. Each of the pixel units P include a pixel transistor TR, which is electrically coupled (e.g., electrically connected) to a gate line GL and a data line DL, a liquid crystal capacitor CLC, which is electrically coupled to the pixel transistor TR, and a storage capacitor CST, which is electrically coupled to the liquid crystal capacitor CLC.

The first gate driver circuit 200-1 is disposed in a first peripheral area PA1 of the peripheral area, which is adjacent to a first end portion of a gate line GL. The first gate driver circuit 200-1 is coupled (e.g., connected) to first end portions of the gate lines GL and to first end portions of the storage lines STL.

The second gate driver circuit 200-2 is disposed in a second peripheral area PA2 of the peripheral area, which is adjacent to a second end portion of the gate line GL. The second gate driver circuit 200-2 is coupled to second end portions of the gate lines GL and to second end portions of the storage lines STL.

According to an example embodiment, the first gate driver circuit 200-1 is the same or substantially the same as the second gate driver circuit 200-2. The first and second gate driver circuits 200-1 and 200-2 respectively output a same gate signal to a same gate line, and respectively output a same storage signal to a same storage line. The display apparatus includes the first and second gate driver circuits 200-1 and 200-2, such as a dual gate structure, so that an RC delay difference of the gate signals may be improved.

The first and second gate driver circuits 200-1 and 200-2 are substantially the same as that described in the previous example embodiment referring to FIGS. 2 and 3.

Referring to FIGS. 2, 3, and 15, each of the first and second gate driver circuits 200-1 and 200-2 is configured to generate a plurality of gate signals G1, . . . , GM, and to output the gate signals G1, . . . , GM to the gate lines GL. In addition, each of the first and second gate driver circuits 200-1 and 200-2 includes a first level switch 203, which is configured to generate a plurality of first storage signals ST1, . . . , STM, and to output the first storage signals ST1, . . . , STM to the storage lines STL.

Each of the storage signals ST1, . . . , STM is synchronized with each of the gate signals G1, . . . , GM, and has a phase opposite to that of its corresponding one of the gate signals G1, . . . , GM. For example, the storage signal has a first storage low voltage during a period in which the gate signal has a gate on voltage, and has a storage high voltage during a period in which the gate signal has a gate off voltage.

A swing voltage between the storage low voltage and the storage high voltage may compensate for a pixel voltage dropped by a kickback voltage of the pixel unit P. One of the storage low voltage and the storage high voltage may be substantially the same as the common voltage Vcom of the LC capacitor CLC.

The data driver circuit 400 may be disposed on the peripheral area, such as the TCP, and is coupled to the data lines DL. The data driver circuit 400 is configured to output the data signals to the data lines.

According to an example embodiment, both end portions of the gate line receives the gate signal without the RC delay from the first and second gate driver circuits, such as the dual gate structure. Thus, the pixel units, which are adjacent to both end portions of the gate line, have a same kickback voltage, and the same kickback voltage may be compensated using the swing voltage between the storage low voltage and the storage high voltage.

Figure 16:
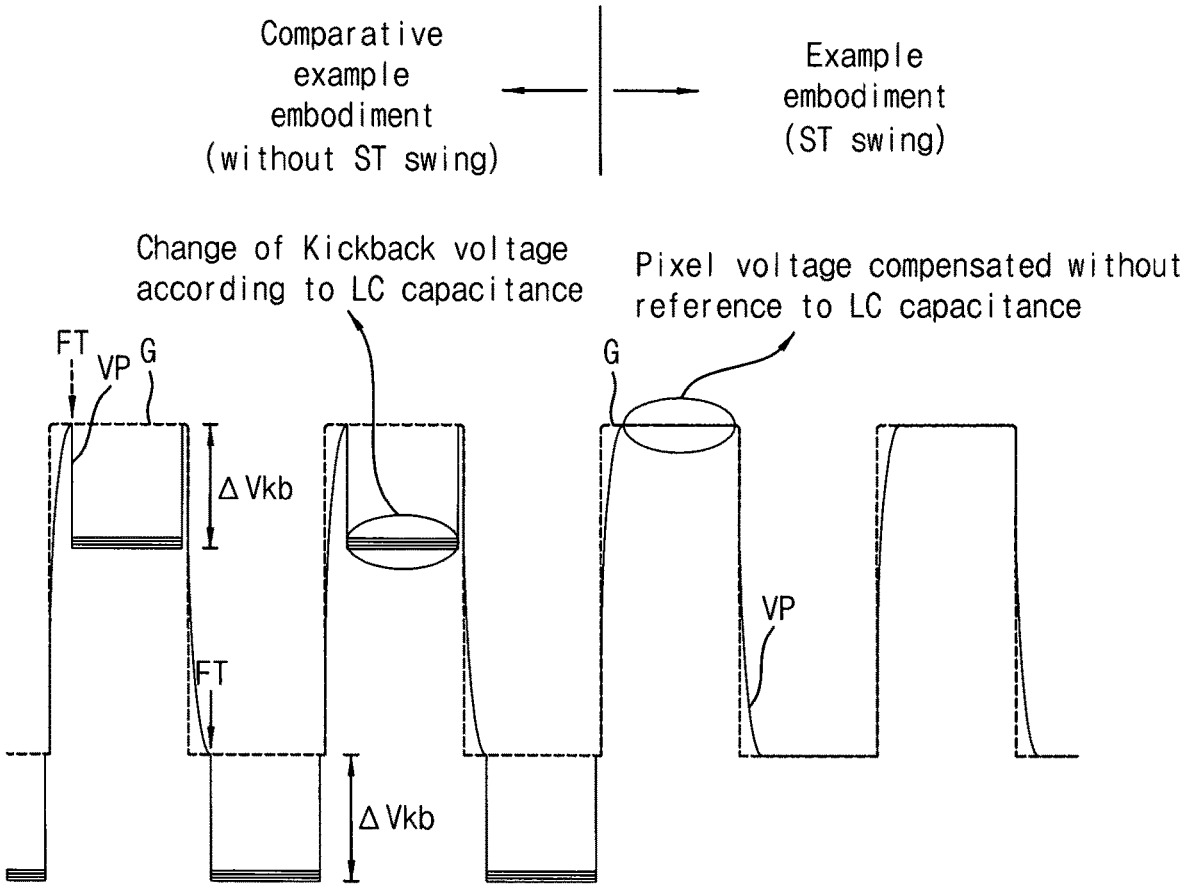
FIG. 16 is a waveform diagram illustrating a method for compensating a kickback voltage according to an example embodiment.

FIG. 16 is a waveform diagram illustrating a method of compensating a kickback voltage according to an example embodiment.

Referring to FIG. 16, a display apparatus according to a comparative example embodiment includes a storage capacitor that receives a DC signal as the storage signal. On the other hand, the display apparatus according to an example embodiment of the present invention includes a storage capacitor that receives the storage signal having a storage low voltage and a storage high voltage in synchronization with the gate signal.

According to the comparative example embodiment, a pixel voltage VP charged in an LC capacitor is decreased by a kickback voltage ΔVkb during a falling timing of the gate signal G. In addition, the kickback voltage ΔVkb is changed according to an LC capacitance corresponding to a grayscale level, and thus, the pixel voltage VP is changed. Therefore, according to the comparative example embodiment, the kickback voltage is changed according to the data voltage applied to the LC capacitor, and thus, is difficult to be compensated.

However, according to the example embodiment of the present invention, the kickback voltage is compensated using the storage signal having a multi-level, so that the pixel voltage VP charged in the LC capacitor may be maintained to a target pixel voltage. The kickback voltage may be compensated without reference to the LC capacitance, that is, the data voltage applied to the LC capacitor.

Accordingly, according to some example embodiments of the present invention, the storage signal for the storage capacitor includes a multi-level signal swing between a low voltage and a high voltage in synchronization with the gate signal, and thus, the kickback voltage may be compensated without reference to a change of the LC capacitance.

The example embodiments described above is illustrative of the present invention, and is not to be construed as limiting thereof. Although a few example embodiments of the present invention have been described, those skilled in the art will readily appreciate that various modifications are possible without materially departing from the spirit and scope of the present invention. Accordingly, all such modifications are intended to be included within the spirit and scope of the present invention, as defined in the claims and their equivalents. In the claims, means-plus-function clauses, if any, are intended to cover the structures described herein as performing the recited function, and not only structural equivalents but also equivalent structures. Therefore, it is to be understood that the foregoing is illustrative of the present invention, and is not to be construed as limited to the specific example embodiments described herein, and that modifications to the described example embodiments, as well as other example embodiments, are intended to be included within the spirit and scope of the appended claims and their equivalents. The spirit and scope of the present invention is defined by the following claims and their equivalents.

What is claimed is:

1. A display apparatus comprising:

a display panel comprising a gate line, a storage line adjacent to the gate line, and a pixel, the pixel comprising a pixel transistor coupled to the gate line, a liquid crystal ("LC") capacitor coupled to the pixel transistor, and a storage capacitor coupled to the LC capacitor;

a first gate driver configured to provide a gate signal to the gate line; and a first level switch configured to provide a storage signal to the storage line, the storage signal being synchronized with the gate signal and having a phase opposite to a phase of the gate signal, wherein the first level switch comprises:

a first switch configured to output a first storage low voltage to the storage line in response to a gate on voltage of the gate signal and a gate off voltage of an opposite gate signal having a phase opposite to that of the gate signal, the first switch comprising a first transistor coupled in parallel to a second transistor, wherein a gate electrode of the first transistor is configured to receive the gate signal and a gate electrode of the second transistor is configured to receive the opposite gate signal; and a second switch configured to output a storage high voltage to the storage line in response to the gate on voltage of the opposite gate signal and the gate off voltage of the gate signal, the second switch comprising a third transistor coupled in parallel to a fourth transistor, wherein a gate electrode of the third transistor is configured to receive the gate signal and a gate electrode of the fourth transistor is configured to receive the opposite gate signal.

2. The display apparatus of claim 1, wherein the storage signal has the first storage low voltage during a period when the gate signal has the gate on voltage, and the storage high voltage during a period when the gate signal has the gate off voltage.

3. The display apparatus of claim 2, wherein a first swing voltage between the first storage low voltage and the storage high voltage is utilized to compensate for a kickback voltage of the pixel.

4. The display apparatus of claim 2, wherein one of the first storage low voltage and the storage high voltage is equal to a common voltage for the LC capacitor.

5. The display apparatus of claim 2, wherein the display panel is divided into a display area including the pixel, and a peripheral area surrounding the display area, wherein the first gate driver is on the peripheral area and is configured to generate the opposite gate signal.

6. The display apparatus of claim 5, wherein the first gate driver comprises the first level switch.

7. The display apparatus of claim 6, further comprising a second level switch on a portion of the peripheral area that is adjacent to a second end portion of the gate line, wherein the first gate driver is on another portion of the peripheral area that is adjacent to a first end portion of the gate line.

8. The display apparatus of claim 7, wherein the display panel further comprises a control line configured to transfer the opposite gate signal.

9. The display apparatus of claim 8, wherein the second level switch comprises:

a third switch configured to output a second storage low voltage greater than the first storage low voltage to the storage line in response to the gate on voltage of the gate signal, and a fourth switch configured to output the storage high voltage to the storage line in response to the gate on voltage of the opposite gate signal transferred through the control line.

10. The display apparatus of claim 9, wherein a kickback voltage of a first pixel adjacent to the first gate driver is configured to be compensated by a first swing voltage between the first storage low voltage and the storage high voltage, and a kickback voltage of a second pixel adjacent to the second level switch is configured to be compensated by a second swing voltage between the second storage low voltage and the storage high voltage.

11. The display apparatus of claim 6, further comprising a second gate driver, wherein the first gate driver is on a portion of the peripheral area that is adjacent to a first end portion of the gate line, and the second gate driver is on another portion of the peripheral area that is adjacent to a second end portion of the gate line.

12. The display apparatus of claim 6, wherein the first level switch is directly integrated in the peripheral area.

13. A display apparatus comprising:

a display panel comprising a gate line, a storage line adjacent to the gate line, and a pixel, the pixel comprising a pixel transistor coupled to the gate line, a liquid crystal ("LC") capacitor coupled to the pixel transistor, and a storage capacitor coupled to the LC capacitor;

a first gate driver configured to provide a gate signal to the gate line; and a first level switch configured to provide a storage signal to the storage line, the storage signal being synchronized with the gate signal and having a phase opposite to a phase of the gate signal, wherein the first gate driver comprises a plurality of stages coupled one after another to each other, and including an n-th stage ("n" is a natural number) comprising a first level switch part coupled between a first output terminal configured to output an n-th gate signal and a third output terminal configured to output an n-th storage signal, the first level switch part being configured to provide the n-th storage signal to an n-th storage line, the n-th storage signal being synchronized with the n-th gate signal and having a phase opposite to a phase of the n-th gate signal, wherein the first level switch part comprises:

a first transistor including an input electrode coupled to a third voltage terminal receiving a storage low voltage, a control electrode coupled to the first output terminal, and an output electrode coupled to the third output terminal; and a second transistor including an input electrode coupled to a fourth voltage terminal receiving a storage high voltage, a control electrode coupled to the first output terminal, and an output electrode coupled to the third output terminal.

14. The display apparatus of claim 13, wherein the n-th stage further comprises:

a pull-up part configured to output a high voltage of the n-th gate signal by utilizing a high voltage of a clock signal in response to a high voltage of a control node;

a control pull-down part configured to pull-down a voltage of the control node to a low voltage in response to a carry signal outputted from at least one of next stages of the n-th stage;

a carry part configured to output the high voltage of the clock signal as an n-th carry signal in response to the high voltage of the control node; and an output pull-down part configured to pull-down the n-th gate signal to the low voltage in response to a carry signal outputted from at least one of next stages of the n-th stage.

15. A method of driving a display apparatus comprising a gate line, a storage line adjacent to the gate line, and a pixel, the pixel comprising a pixel transistor coupled to the gate line, a liquid crystal ("LC") capacitor coupled to the pixel transistor, and a storage capacitor coupled to the LC capacitor, the method comprising:

providing a gate signal to the gate line; and providing a storage signal to the storage line, the storage signal being synchronized with the gate signal and having a phase opposite to a phase of the gate signal, wherein the display apparatus further comprises a first gate driver configured to provide the gate signal to the gate line, and a first level switch configured to provide the storage signal to the storage line, wherein the first level switch comprises:

a first switch configured to output a first storage low voltage to the storage line in response to a gate on voltage of the gate signal and a gate off voltage of an opposite gate signal having a phase opposite to that of the gate signal, the first switch comprising a first transistor coupled in parallel to a second transistor, wherein a gate electrode of the first transistor is configured to receive the gate signal and a gate electrode of the second transistor is configured to receive the opposite gate signal; and a second switch configured to output a storage high voltage to the storage line in response to the gate on voltage of the opposite gate signal and the gate off voltage of the gate signal, the second switch comprising a third transistor coupled in parallel to a fourth transistor, wherein a gate electrode of the third transistor is configured to receive the gate signal and a gate electrode of the fourth transistor is configured to receive the opposite gate signal.

16. The method of claim 15, further comprising:

providing a first end portion of the storage line with the storage signal, the storage signal having the first storage low voltage during a period when the gate signal has the gate on voltage, and the storage high voltage during a period when the gate signal has the gate off voltage.

17. The method of claim 16, further comprising:

providing a second end portion of the storage line with the storage signal, the storage signal having a second storage low voltage that is greater than the first storage low voltage during the period when the gate signal has the gate on voltage, and the storage high voltage during the period when the gate signal has the gate off voltage.

18. The method of claim 16, wherein one of the first storage low voltage and the storage high voltage is equal to a common voltage for the LC capacitor.

* * * * *